US008275301B2

(12) United States Patent
Watanabe et al.

(10) Patent No.: US 8,275,301 B2
(45) Date of Patent: Sep. 25, 2012

(54) CLEANING DEVICE, METHOD OF MANUFACTURING THE CLEANING DEVICE, AND PROCESS UNIT AND IMAGE FORMING APPARATUS USING SAME

(75) Inventors: Kazuhiko Watanabe, Machida (JP); Yoshiki Hozumi, Sagamihara (JP); Takeshi Saitoh, Hachioji (JP)

(73) Assignee: Ricoh Company, Limited, Tokyo (JP)

( * ) Notice: Subject to any disclaimer, the term of this patent is extended or adjusted under 35 U.S.C. 154(b) by 774 days.

(21) Appl. No.: 12/266,877

(22) Filed: Nov. 7, 2008

(65) Prior Publication Data

US 2009/0123205 A1 May 14, 2009

(30) Foreign Application Priority Data

Nov. 8, 2007 (JP) ..... 2007-290818
Apr. 28, 2008 (JP) ..... 2008-117023

(51) Int. Cl.
*G03G 21/00* (2006.01)

(52) U.S. Cl. ..... 399/350; 399/402; 399/101

(58) Field of Classification Search ..... 399/350, 399/402, 101
See application file for complete search history.

(56) References Cited

U.S. PATENT DOCUMENTS

| | | | | |
|---|---|---|---|---|
| 3,954,568 | A | 5/1976 | DuPree | |
| 5,991,568 | A * | 11/1999 | Ziegelmuller et al. | 399/102 |
| 2005/0180785 | A1* | 8/2005 | Murakami et al. | 399/297 |
| 2006/0285898 | A1* | 12/2006 | Watanabe et al. | 399/350 |
| 2007/0189800 | A1* | 8/2007 | Ushikubo | 399/100 |
| 2008/0063448 | A1 | 3/2008 | Hozumi et al. | |

FOREIGN PATENT DOCUMENTS

| | | |
|---|---|---|
| JP | 52-36016 | 9/1977 |
| JP | 5-19671 | 1/1993 |
| JP | 10-39707 | 2/1998 |
| JP | 2002-258701 | 9/2002 |
| JP | 2002-372858 | * 12/2002 |
| JP | 2004-272019 | 9/2004 |
| JP | 2004-279518 | 10/2004 |
| JP | 2005-10576 | 1/2005 |
| JP | 2006-154747 | 6/2006 |
| JP | 2006-195348 | 7/2006 |
| JP | 2006-259547 | 9/2006 |
| JP | 2007-264347 | 10/2007 |
| JP | 2009-204917 | 9/2009 |

OTHER PUBLICATIONS

Office Action issued Mar. 30, 2012, in Japanese Patent Application No. 2008-117023.
Chinese Office Action issued Apr. 13, 2010, in Patent Application No. 200810174534.0.

* cited by examiner

*Primary Examiner* — Walter Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A cleaning device including a cleaning blade configured to clean a surface of a cleaning target that is moving. A leading edge which is formed between lower and leading surfaces of the cleaning blade is obtuse-angled with respect to the lower surface and is in contact with the surface of the cleaning target during use. The leading surface of the cleaning blade is curved outward when the cleaning blade is not in contact with the cleaning target.

10 Claims, 13 Drawing Sheets

CLEANING DEVICE, METHOD OF MANUFACTURING THE CLEANING DEVICE, AND PROCESS UNIT AND IMAGE FORMING APPARATUS USING SAME

CROSS-REFERENCE TO RELATED APPLICATIONS

This document claims priority from and contains subject matter related to Japanese Patent Application Nos. 2007-290818 and 2008-117023, filed on Nov. 8, 2007 and Apr. 28, 2008, respectively, the entire contents of each of which are hereby incorporated herein by reference.

BACKGROUND

1. Field of the Invention

The present invention relates to a cleaning device for use in copiers, facsimiles, printers, and the like, and more particularly to a cleaning device using an elastic cleaning blade to remove toner particles remaining on a surface of a cleaning target. The present invention also relates to a method of manufacturing the cleaning blade, and to a process unit and an image forming apparatus using the cleaning device.

2. Description of the Background

A typical electrophotographic image forming apparatus includes a cleaning device configured to remove residual toner particles that remain on a surface of an image bearing member, such as a latent image bearing member and an intermediate transfer member, without being transferred onto a recording medium or another image bearing member.

A cleaning blade is widely used as a cleaning member in a typical cleaning device because of its simple configuration and excellent cleaning ability. A typical cleaning blade is made of an elastic material such as polyurethane rubber. One end of the cleaning blade is supported by a support member and another end (hereinafter "a leading end") is pressed against a surface of an image bearing member so as to scrape off residual toner particles remaining on the image bearing member.

To facilitate description, a surface of the cleaning blade that faces the image bearing member is hereinafter referred to as a lower surface, a surface opposite the lower surface away from the image bearing member is hereinafter referred to as an upper surface, and a surface of the leading end is hereinafter referred to as a leading surface. An edge formed by the lower and leading surfaces is hereinafter referred to as a leading edge.

Ordinarily, the leading edge is in contact with the image bearing member, and a cleaning blade with a configuration in which the leading surface is perpendicular to the lower and upper surfaces is easily manufacturable. Therefore, most cleaning blades have a right-angled leading edge for reasons of manufacturability.

FIGS. 1A and 1B are schematic views illustrating an embodiment of a related-art cleaning blade 2' of which a leading edge 21' is right-angled. FIG. 1A is an overall view of the cleaning blade 2' and FIG. 1B is a magnified view of a region circled with dotted lines in FIG. 1A at a peripheral portion of the leading edge 21' of the cleaning blade 2', which is in contact with a photoconductor 1 serving as an image bearing member.

When the right-angled leading edge 21' contacts the photoconductor 1 the surface of which is moving in a direction indicated by arrow D in FIGS. 1A and 1B, the leading edge 21' may be stretched in the direction indicated by arrow D due to friction between it and the photoconductor 1. As a result, the leading edge 21' may deform considerably as illustrated in FIG. 1B.

The larger the degree of deformation of the leading edge 21', the longer a length of contact of the cleaning blade 2' with the photoconductor 1 in the direction indicated by arrow D, in other words, the larger an area of contact of the cleaning blade 2' with the photoconductor 1. As the area of contact widens, the pressure exerted per unit area (hereinafter "surface pressure") applied by the cleaning blade 2' on the photoconductor 1 decreases, because a load applied by the cleaning blade 2' on the photoconductor 1 is distributed more widely. The reduced surface pressure enables toner particles to slip though the cleaning blade 2', resulting in insufficient removal of toner particles, that is, insufficient cleaning.

If the load applied by the cleaning blade 2' on the photoconductor 1 is increased to increase the surface pressure, torque produced by movement of the surface of the photoconductor 1 may increase, thereby overloading driving systems.

To solve the above-described problems caused by deformation the leading edge, one proposed approach involves making the leading edge obtuse-angled with respect to the lower surface of the cleaning blade.

FIGS. 2A and 2B are schematic views illustrating an embodiment of a cleaning blade 2" of which a leading edge 21" is obtuse-angled. FIG. 2A is an overall view of the cleaning blade 2" and FIG. 2B is a magnified view of a region circled with dotted lines in FIG. 2A.

The cleaning blade 2" the leading edge 21" of which is obtuse-angled deforms only slightly even when being stretched in the direction indicated by arrow D due to friction between it and the photoconductor 1, as illustrated in FIG. 2B.

The smaller the degree of deformation of the leading edge 21", the shorter a length of contact of the cleaning blade 2" with the photoconductor 1 in the direction indicated by arrow D, in other words, the smaller an area of contact of the cleaning blade 2" with the photoconductor 1. As the area of contact narrows, the surface pressure applied by the cleaning blade 2" on the photoconductor 1 increases even if the load is kept constant. The increased surface pressure prevents toner particles from slipping though the cleaning blade 2", resulting in reliable removal of toner particles.

Such a cleaning blade of which the leading edge is obtuse-angled is disclosed in Unexamined Japanese Patent Application Publication Nos. 05-19671 and 2004-272019. However, these cleaning blades are not reliably prevented from deforming because they lack sufficient thickness at the base of the leading edge to keep them from doing so.

SUMMARY

Accordingly, illustrative embodiments of the present invention provide a cleaning device in which a leading edge of a cleaning blade is reliably prevented from deforming.

One illustrative embodiment provides a cleaning device including a cleaning blade configured to clean a moving surface of a cleaning target. A leading edge of the cleaning blade formed between lower and leading surfaces of the cleaning blade is obtuse-angled with respect to the lower surface and is in contact with the surface of the cleaning target when in use. The leading surface of the cleaning blade is curved outward when the cleaning blade is at rest, that is, is not in contact with the cleaning target.

Another illustrative embodiment provides a process unit detachably attachable to an image forming apparatus, including a cleaning target having a surface that is moving and the cleaning device described above.

Yet another illustrative embodiment provides an image forming apparatus including an image bearing member having a surface that is moving; a charging device configured to charge the surface of the image bearing member; a latent image forming member configured to form an electrostatic latent image on the surface of the image bearing member; a developing device configured to develop the electrostatic latent image to form a toner image; a transfer device configured to transfer the toner image from the image bearing member onto a transfer material; and the cleaning device described above. The cleaning device is configured to remove undesirable substances remaining on the surface of the image bearing member after the toner image is transferred therefrom.

Additionally, the present invention provides a method of manufacturing a cleaning blade, including fixing an elastic sheet onto first and second support surfaces; sandwiching the elastic sheet between the second support surface and a sheet contact surface of a sandwiching plate with a predetermined pressure; rotating the second support surface so as to slant downward at an angle of approximately 10 degrees relative to the first support surface so as to form a substantially circular arc; cutting the elastic sheet with a cutter along a line where the elastic sheet starts to follow the downward slant of the second support surface; pulling the elastic sheet away from the cutter at a direction perpendicular to a direction in which the cutter cuts the elastic sheet; withdrawing the cutter from the elastic sheet; and discarding an unused portion of the elastic sheet after the cutter is withdrawn.

These and other objects of the present invention, either individually or in combination thereof, as hereinafter will become more readily apparent can be attained by illustrative embodiments described below.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DETAILED DESCRIPTION

Figure 1A:
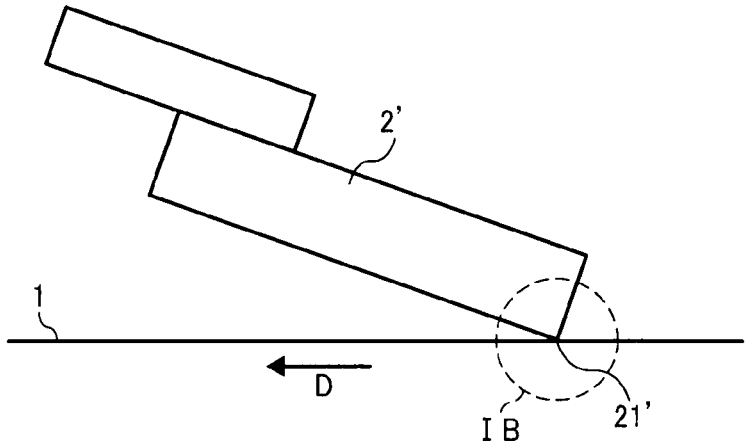
FIG. 1A RELATED ART
FIGS. 1A and 1B are overall and magnified schematic views, respectively, illustrating an embodiment of a related-art cleaning blade of which a leading edge is right-angled.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and illustrative variation, for the sake of simplicity the same reference numerals will be given to identical constituent elements such as parts and materials having the same functions, and redundant descriptions thereof omitted.

A description is now given of a printer as an image forming apparatus according to illustrative embodiments of the present invention.

Figure 3:
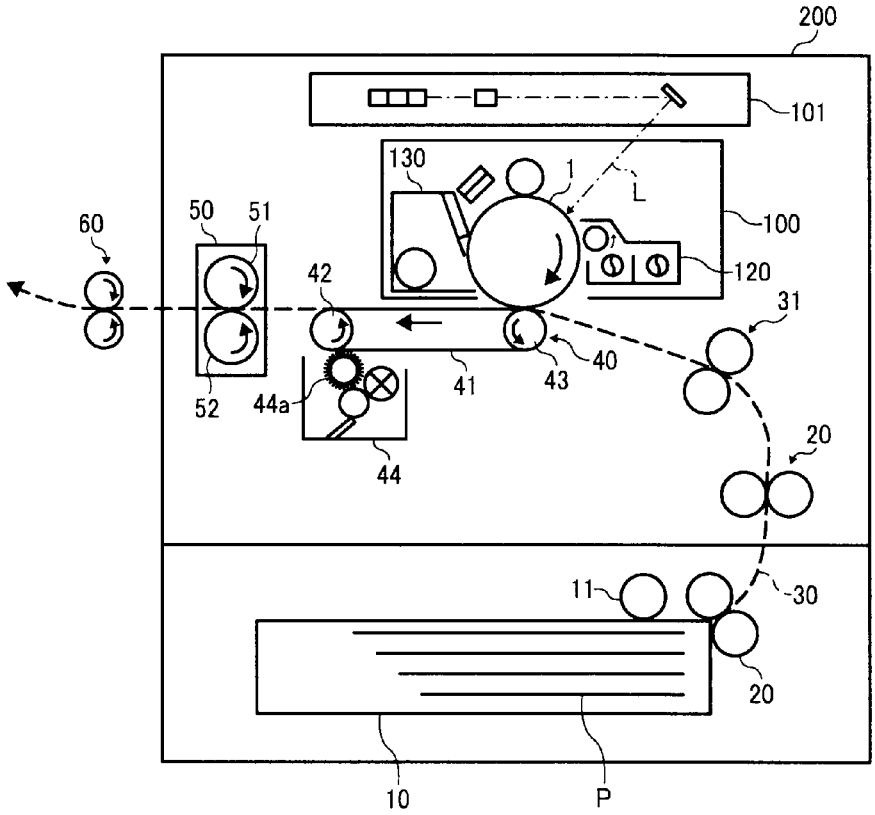
FIG. 3 is a schematic view illustrating an embodiment of a printer according to illustrative embodiments of the present invention.

FIG. 3 is a schematic view illustrating an embodiment of a printer 200 according to illustrative embodiments of the present invention. The printer 200 includes a process unit 100, an optical writing unit 101, a paper feed cassette 10, pairs of conveyance rollers 20, a paper conveyance path 30, a pair of registration rollers 31, a transfer conveyance unit 40, a fixing device 50, and a pair of paper ejection rollers 60.

The optical writing unit 101 includes a light source, a polygon mirror, an f-θ lens, and a reflecting mirror. The optical writing unit 101 is configured to direct a laser light beam onto a surface of a photoconductor, to be described later, based on image information.

Figure 4:
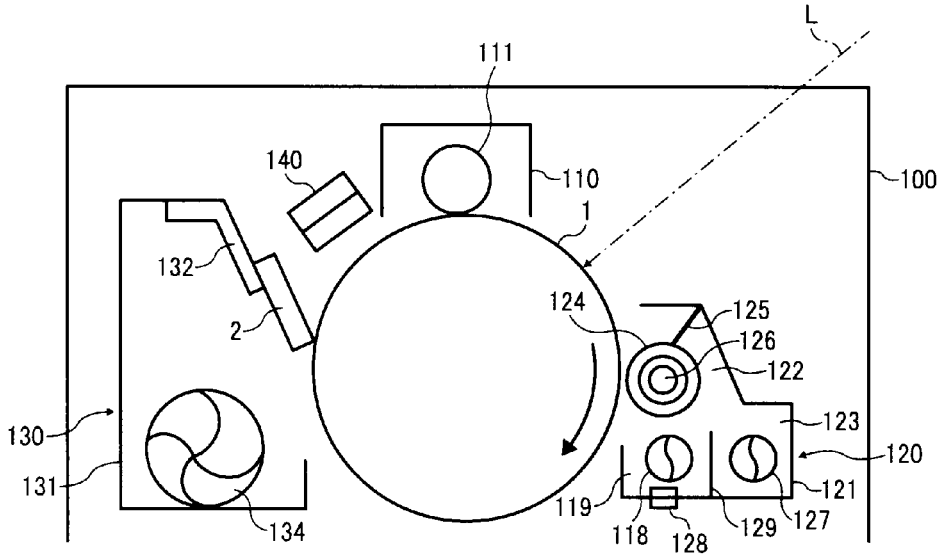
FIG. 4 is a schematic view illustrating an embodiment of the process unit included in the printer shown in FIG. 3.

FIG. 4 is a schematic view illustrating an embodiment of the process unit 100 included in the printer 200. The process unit 100 includes a photoconductor 1, a charging device 110, a developing device 120, a photoconductor cleaning device 130, and a decharging device 140.

The charging device 110 includes a charging roller 111 serving as a rotatable charging member that is driven to rotate while a charging bias is applied thereto. The charging roller 111 faces the photoconductor 1, serving as an image bearing member, forming a micro gap therebetween. The photoconductor 1 is evenly charged by electricity discharged from the charging roller 111 toward the photoconductor 1 across the micro gap. The charging roller 111 is rotated to immediately make a surface of the charging roller 111, which has discharged electricity, withdraw from the micro gap and to make another surface of the charging roller 111, which has not yet discharged electricity, enter the micro gap, thereby providing consistent electric discharge.

A typical charging device employs a corona charging method that uses corona discharge. In the corona charging method, a charging wire is provided adjacent to a charging target, and a high voltage is then applied to the charging wire, so that corona discharge occurs between the charging wire and the charging target to charge the charging target. However, the corona charging method has a drawback in which undesirable by-products such as ozone and nitrogen oxides (NOx) are produced by corona discharge. There is a possibility that these by-products form a film of nitric acid or a nitrate on a surface of the photoconductor, which may adversely affect image formation.

In attempting to solve the above-described problem, a contact charging method and an adjacent charging method have been developed recently. In the contact and adjacent charging methods, a charging member, such as a roller, a brush, or a blade, is provided in contact with or adjacent to a charging target, such as a photoconductor, while a voltage is applied to the charging member, so that the charging target is charged. The contact and adjacent charging methods have advantages of producing fewer undesirable by-products and using less electric power than the corona charging method. In addition, the contact and adjacent charging methods need no large-scale charging device, making them applicable to compact image forming apparatuses in accordance with recent market demand.

The printer 200 employs a non-contact roller charging method which is one of the adjacent charging method. As described above, the contact charging method, in which a charging target is charged by electric discharge from a charging member to which an alternating current is applied and which is in contact with the charging target, is also applicable to the printer 200. When the contact charging method is used, it is preferable that the charging member intimately contacts the surface of the charging target and includes an elastic member so as not to apply mechanical stress to the charging target. However, it should be noted that the elastic member may widen a charging nip, possibly causing easy adherence of protective materials (i.e., lubricants to be described later) to the charging member. Accordingly, non-contact charging methods have an advantage over contact charging methods in terms of durability. For this reason, the printer 200 employs a non-contact charging method to evenly charge the photoconductor 1.

Figure 5:
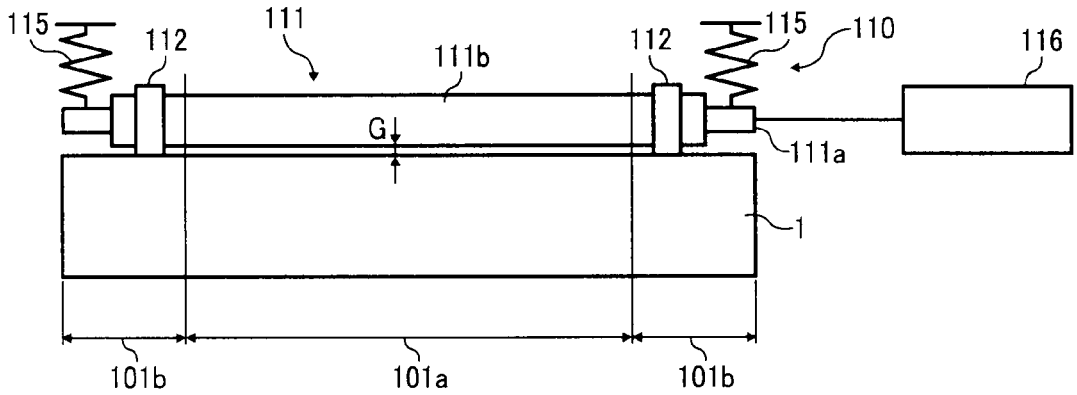
FIG. 5 is a magnified schematic view illustrating embodiments of the charging device and the photoconductor included in the process unit shown in FIG. 4.

FIG. 5 is a magnified schematic view illustrating embodiments of the charging device 110 and the photoconductor 1. The charging device 110 includes the charging roller 111, spacers 112, springs 115, and a power source 116. The charging roller 111 includes a shaft part 111*a* and a roller part 111*b*. The roller part 111*b* is disposed facing the photoconductor 1 and has a function of charging a surface of the photoconductor 1. The roller part 111*b* is rotatable in accordance with a rotation of the shaft part 111*a*. The spacers 112 serving as gap forming members are provided so that the roller part 111*b* faces a surface of the photoconductor 1 across a micro gap G therebetween. Consequently, an image forming region 101*a* of the photoconductor 1 is not in contact with the roller part 111*b*. The roller part 111*b* has a longitudinal length longer than that of the image forming region 101*a*, and therefore the spacers 112 are in contact with non-image forming regions 101*b* to form the micro gap G. The charging roller 111 rotates so as to follow the rotation of the photoconductor 1 via the spacers 112. The micro gap G is set so that a minimum distance between the roller part 111*b* and the photoconductor is from 1 to 100 μm. Preferably, the minimum distance is from 30 to 65 μm. In the printer 200, the micro gap G is set to 50 μm.

The springs 115 are provided on the shaft part 111*a*, and press the charging roller 111 against the photoconductor 1, thereby reliably and accurately forming the micro gap G. The power source 116 is connected with the shaft part 111*a* to apply an alternating current thereto. As a result, electric discharge occurs in the micro gap G, thereby evenly charging a surface of the photoconductor 1. In the printer 200, an alternating voltage, in which a direct current (DC) voltage is overlapped with an alternating current (AC) voltage, is applied to the shaft part 111*a*. Such an alternating voltage prevents uneven charging caused by shifts in the micro gap, providing reliable and even charging.

The roller part 111*b* includes a cylindrical cored bar serving as a conductive support and a resistance adjustment layer formed on an outer surface of the cored bar. The roller part 111*b* has a diameter of 10 mm.

The surface of the roller part 111*b* is made of a known material such as rubber, however, the surface of the roller part 111*b* is preferably made of resin. There is a possibility that rubbers adsorb water or generate flexure. In these cases, the micro gap G may be inconsistently formed. There is also a possibility that a center part of the roller part 111*b* extemporaneously contacts a surface of the photoconductor 1 depending on image forming conditions, causing unreliable charging of the photoconductor 1. Accordingly, a hard material capable of consistently forming the micro gap G is preferably used when the photoconductor 1 is charged by a non-contact charging method.

For example, the resistance adjustment layer of the roller part 111*b* preferably includes a hard material such as a composition of thermoplastic resins (e.g., polyethylene, polypropylene, polymethyl methacrylate, polystyrene, and mixtures thereof) in which a polymeric ion conductive agent is dispersed, and the surface of the resistance adjustment layer is preferably hardened using a hardening agent. The surface of the resistance adjustment layer can be hardened by being dipped in a treatment liquid including an isocyanate compound, for example. Alternatively, an independent hardened layer may be formed on the resistance adjustment layer.

Referring back to FIG. 3, the charged surface of the photoconductor 1 is exposed to a laser light beam L modulated and deflected by the optical writing unit 101. As a result, the potential of the exposed portion of the photoconductor 1 decreases, thereby forming an electrostatic latent image thereon. The electrostatic latent image thus formed is developed by the developing device 120 to form a toner image.

The photoconductor 1 includes a cylinder made of aluminum or the like material, a photoconductive layer including an organic photoconductive material covering the cylinder, and a charge transport layer further covering the photoconductive layer. The photoconductor 1 may be either drum-shaped or belt-shaped.

Referring to FIG. 4, the developing device 120 includes a developing casing 121 including a developing part 122, a developer supply part 119, and a developer agitation part 123. The developing part 122 includes a developing sleeve 124 serving as a developer bearing member of which part of the surface is exposed from an opening in the developing casing 121, and a doctor blade 125.

The developing sleeve 124 has a cylindrical shape and is made of a non-magnetic material. The surface of the developing sleeve 124 is roughened by sandblasting to improve an ability to convey a developer. Alternatively, the surface of the developing sleeve 124 may have microgrooves. The developing sleeve 124 is rotated by a driving source, not shown. A fixed magnetic roller 126 is disposed inside the developing sleeve 124 and does not rotate with the rotation of the developing sleeve 124. The magnetic roller 126 includes a plurality of magnets producing a plurality of magnetic poles distributed in a circumferential direction thereof. A plurality of magnetic fields is formed on a circumference of the developing sleeve 124 by the plurality of magnetic poles.

The developer supply part 119 and the developer agitation part 123 each contain developer including magnetic carrier and negatively chargeable toner, not shown. The developer supply part 119 includes a supply conveyance screw 118 and a sensor 128 (hereinafter "T sensor") serving as a toner concentration detector. The developer agitation part 123 includes an agitation conveyance screw 127 and a toner supply part, not shown. The developer is agitated and conveyed to a back side of the plane of paper on which FIG. 4 is drawn by the supply conveyance screw 118 while being triboelectrically charged. The developer contacts a surface of the developing sleeve 124 during agitation and conveyance by the supply conveyance screw 118, and the developer is then borne on the surface of the developing sleeve 124 by the magnetic field extending from the surface of the developing sleeve 124 toward the developer supply part 119. As a result, the developer is drawn up from the developer supply part 119 onto the developing sleeve 124 in accordance with the rotation of the surface thereof, and subsequently conveyed to a position facing the doctor blade 125 in accordance with the rotation of the surface thereof. The developer then passes through a gap (hereinafter "doctor gap") between the developing sleeve 124 and the doctor blade 125 so that the thickness of the developer layer on the developing sleeve 124 is controlled and the toner is triboelectrically charged further.

After passing through the doctor gap, the developer is conveyed to a developing area, at which the developing sleeve 124 faces the photoconductor 1, in accordance with the rotation of the surface of the developing sleeve 124. In the developing area, the photoconductor 1 faces the developing sleeve 124 forming a predetermined developing gap therebetween. Further, in the developing area, the magnetic carrier particles in the developer are formed into a brush-like shape (hereinafter "magnetic brush") on the surface of the developing sleeve 124 due to a magnetic force of a developing magnetic pole of the magnetic roller 126. A leading edge of each of the magnetic brushes abrasively contacts the photoconductor 1 so that the toner particles adhere to an electrostatic latent image previously formed on the photoconductor 1 to form a toner image on the photoconductor 1.

Toner particles in the developer are consumed in the process of formation of the toner image whereas carrier particles are not. Such used developer now including fewer toner particles returns to the developing device 120 as the developing sleeve 124 rotates and is released from the surface of the developing sleeve 124 by gravity and by the force of a repulsive magnetic field formed inside the printer. Thus, the developer returns to the developer supply part 119 positioned below the developing part 122.

A partition 129 is provided between the developer supply part 119 including the supply conveyance screw 118 and the developer agitation part 123 including the agitation conveyance screw 127. In the developer supply part 119, the supply conveyance screw 118 is driven to rotate by a driving source, not shown, and supply the developer to the developing sleeve 124 while conveying the developer from a front side to a back side of the plane of paper, as described above. The developer conveyed to a back end of the plane of paper then moves to the developer agitation part 123 through an opening, not shown, provided on the partition 129. In the developer agitation part 123, the developer is then conveyed from a back side to a front side of the plane of paper by the rotation of the agitation conveyance screw 127. The developer thus conveyed returns to the developer supply part 119 through another opening, not shown, provided on the partition 129. Thus, the developer is circulated within the developing device 120.

The T sensor 128 is a magnetic permeability sensor. The T sensor 128 outputs a voltage corresponding to a magnetic permeability of the developer conveyed by the supply conveyance screw 118. Since the magnetic permeability of the developer correlates generally with the toner concentration, the T sensor 128 in effect outputs a voltage corresponding to a toner concentration. The outputted voltage is sent to a control unit, not shown. The control unit includes a RAM containing a target value Vterf for the outputted voltage from the T sensor 128. A toner supply device, not shown, is controlled with reference to the target value Vterf. Specifically, the control unit drives the toner supply device to supply a toner from a toner supply part, not shown, to the developer agitation part 123 in the developing device 120 so that the outputted voltage from the T sensor 128 approaches the target value Vterf. Thus, the toner concentration in the developer contained in the developing device 120 is kept constant.

The toner image formed on the photoconductor 1 is transferred onto a transfer paper P conveyed by a conveyance belt 41, to be described later. Residual toner particles remaining on the surface of the photoconductor 1, from which the toner image has been transferred, are removed by the photoconductor cleaning device 130. The photoconductor cleaning device 130 includes a casing 131, a holder 132 serving as a support member, a cleaning blade 2 serving as an elastic cleaning blade, and a collection screw 134. The holder 132 is made of a rigid material such as a metal and a rigid plastic, one end of which is supported by the casing 131 while another end (hereinafter "free end") supports the cleaning blade 2.

The cleaning blade 2 is made of a soft material such as a polyurethane rubber, and a leading edge thereof contacts the photoconductor 1 so as to scrape off residual toner particles remaining thereon. The residual toner particles scraped off from the photoconductor 1 fall onto the collection screw 134. The collection screw 134 is driven to rotate by a driving source, not shown. A cleaning bias with a positive polarity is applied to the collection screw 134 from a power source, not shown. The residual toner particles that have fallen onto the collection screw 134 are then electrostatically attracted thereto, and are conveyed to a waste toner container, not shown, with the rotation of the collection screw 134. The photoconductor 1 which has been cleaned by the photoconductor cleaning device 130 is then decharged by the decharging device 140, and subsequently evenly charged by the charging device 110. Thus, the photoconductor 1 is reset to its initial state.

Referring back to FIG. 3, the paper feed cassette 10 storing a plurality of sheets of the transfer paper P is detachably attached to a lower part of the printer 200. A paper feed roller 11, which is in contact with a top sheet of the transfer paper P in the paper feed cassette 10, is rotated to feed the top sheet toward the paper conveyance path 30. The plurality of pairs of conveyance rollers 20 are provided on the paper conveyance path 30 at predetermined intervals, and the pair of registration rollers 31 is provided in the vicinity of an end of the paper conveyance path 30. The sheet of the transfer paper P (hereinafter simply "transfer paper P") fed from the paper feed cassette 10 is conveyed to the pair of registration rollers 31 by the plurality of pairs of conveyance rollers 20. The pair of registration rollers 31 feeds the transfer paper P to a transfer nip, which is an area of contact between the photoconductor 1 and the conveyance belt 41, in synchronization with entry of the toner image into the transfer nip. As a result, the toner image on the photoconductor 1 adheres to the transfer paper P on the conveyance belt 41 in the transfer nip.

The transfer conveyance unit 40 includes the conveyance belt 41, a conveyance belt driving roller 42, a paper transfer bias roller 43, and a conveyance belt cleaning device 44. The conveyance belt 41 includes, in order from an innermost side thereof, a base layer, an elastic layer, and a surface layer. The base layer is made of a fluorocarbon resin that elongates slightly and/or a rubber that elongates considerably, and a material that elongates only slightly such as canvas is dispersed therein. Specifically, a resin, such as polyvinylidene fluoride, polyimide, polycarbonate, and polyethylene terephthalate, which is molded into a seamless belt, is preferably used as the base layer. A conductive material such as carbon black may be optionally added to the resin so as to adjust conductivity. The surface layer is made of a material having a low surface energy and an ability to reliably release a toner, such as a fluorocarbon resin. The surface layer is formed overlying the base layer by methods such as spray coating and dipping. The elastic layer is made of an elastic material such as a fluorocarbon rubber and an acrylonitrile-butadiene copolymer rubber. The elastic layer gives a certain degree of elasticity to the conveyance belt 41.

The conveyance belt 41 is stretched taut by the conveyance belt driving roller 42 and the paper transfer bias roller 43, and is endlessly moved counterclockwise in FIG. 3 along with the rotation of the conveyance belt driving roller 42 driven by a driving source, not shown. The paper transfer bias roller 43 is provided so as to contact a base layer side (i.e., an inner circumference surface side) of the conveyance belt 41, and a transfer bias is applied thereto from a power source, not shown. The paper transfer bias roller 43 presses the conveyance belt 41 against the photoconductor 1 from the base layer side so that the transfer nip is formed. In the transfer nip, the conveyance belt 41 endlessly moving counterclockwise contacts the photoconductor 1 rotating clockwise, and a transfer electric field is formed between the photoconductor 1 and the paper transfer bias roller 43 due to the transfer bias.

The conveyance belt 41 supports the transfer paper P, fed from the pair of registration rollers 31, on an upper stretched surface thereof. The transfer paper P enters the transfer nip along with the endless movement of the conveyance belt 41. The transfer paper P adheres to the photoconductor 1 in the transfer nip so that the toner image on the photoconductor 1 is transferred onto the transfer paper P by the transfer electric field and by pressure applied in the transfer nip.

The transfer paper P onto which the toner image is transferred exits the transfer nip along with the endless movement of the conveyance belt 41 and is then conveyed to the fixing device 50. A slight amount of toner particles may remain on the surface of the conveyance belt 41 after the conveyance belt 41 feeds the transfer paper P, and the conveyance belt cleaning device 44 removes these toner particles remaining on the conveyance belt 41, owing to a configuration in which the conveyance belt 41 is sandwiched between the conveyance belt cleaning device 44 and the conveyance belt driving roller 42. The conveyance belt cleaning device 44 illustrated in FIG. 3 includes a rotatable fur brush 44*a* configured to scrape toner particles off the conveyance belt 41. Alternatively, a cleaning blade may also be employed in the conveyance belt cleaning device 44.

The fixing device 50 includes a fixing roller 51 containing an internal heat source such as a halogen lamp and a pressing roller 52 pressed against the fixing roller 51. The fixing roller 51 and the pressing roller 52 rotate in the same direction in a fixing nip formed therebetween. The transfer paper P fed from the conveyance belt 41 enters the fixing nip so that heat and pressure are applied to the toner image. The toner image is softened by the heat and pressure thus applied and fixed on the transfer paper P. After passing through the fixing device 50, the transfer paper P is discharged from the printer 200 by the pair of paper discharge rollers 60, or conveyed to a paper reversing unit, not shown, provided on a lower part of the fixing device 50.

Next, the cleaning blade 2 will be described in detail.

Figure 6:
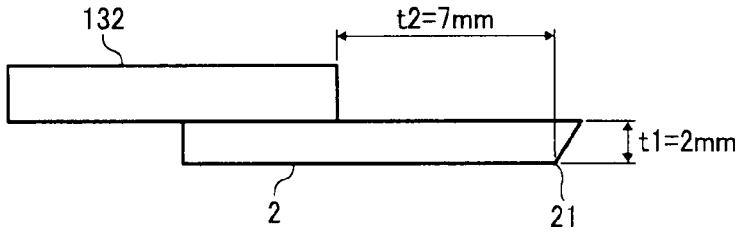
FIG. 6 is a schematic view illustrating an embodiment of the cleaning blade used for the printer.

FIG. 6 is a schematic view illustrating an embodiment of the cleaning blade 2 used for the printer 200.

A leading edge 21 is formed by the lower and leading surfaces of the cleaning blade 2. The leading edge 21 is obtuse-angled with respect to the lower surface of the cleaning blade, and contacts the photoconductor 1 so as to face in the direction of rotation of the photoconductor 1. The obtuse-angled leading edge 21 prevents the occurrence of a reciprocating rocking motion of the cleaning blade 2, which is an undesirable motion called stick-slip motion, thereby reducing abrasion of the cleaning blade 2.

The cleaning blade 2 in the present embodiment has a thickness t1 of 2 mm and a free length t2 of 7 mm. These dimensions are purely illustrative, however, and the thickness t1 and free length t2 are not limited thereto.

Figure 7:
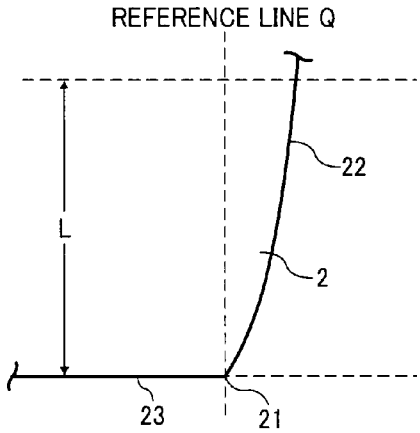
FIGS. 7 to 10 are cross-sectional schematic views illustrating embodiments of the cleaning blade at a peripheral portion of the leading edge.

FIG. 7 is a cross-sectional schematic view illustrating an embodiment of the cleaning blade 2 at a peripheral portion of the leading edge 21.

As illustrated in FIG. 7, a leading surface 22 of the cleaning blade 2 is curved outward relative to a reference line Q, which extends from the leading edge 21 forming right angle with a lower surface 23 of the cleaning blade 2. Such a configuration makes the leading edge 21 substantially obtuse-angled. Such a substantially obtuse-angled leading edge 21 with the curved leading surface 22 makes the peripheral portion thereof thicker compared to a right-angled leading edge with a straight leading surface, thereby preventing deformation of the leading edge 21. In addition, such a configuration prevents the occurrence of the stick-slip motion of the cleaning blade 2, thereby reducing abrasion of the cleaning blade 2.

Figure 8:
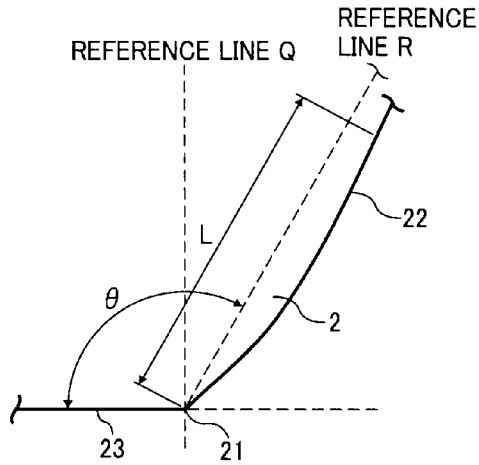
Figure 9:
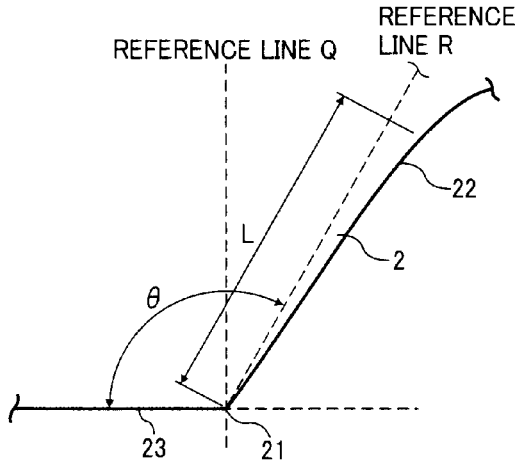
Figure 10:
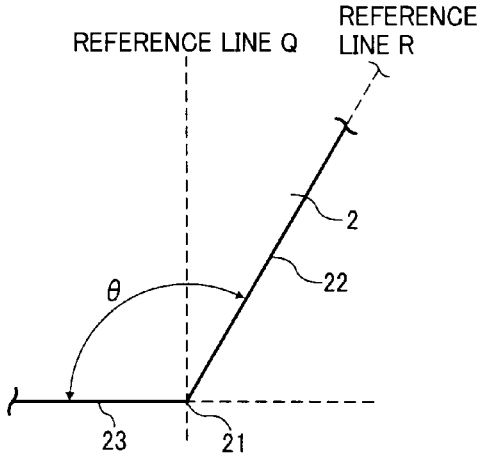

Alternatively, as illustrated in FIGS. 8 and 9, the leading surface 22 may be curved outward relative to another reference line R, which extends from the leading edge 21 forming an angle $\theta$ of 90° or more with the lower surface 23 of the cleaning blade 2. Such a configuration makes the peripheral portion of the leading edge 21 thicker compared to a configuration illustrated in FIG. 10 in which the leading surface 22 extends straight along the reference line R, thereby preventing deformation of the leading edge 21.

The leading surface 22 is preferably curved for a length L of $(10/\sin(\pi-\theta))$ μm or more from the leading edge 21 along the leading surface 22. This is because the leading surface 22 for a length of about 10 to 20 μm from the leading edge 21 along the leading surface 22 easily deforms. Such a leading surface 22 curving outward relative to the reference line R or Q for a length of $(10/\sin(\pi-\theta))$ μm or more from the leading edge 21 along the leading surface 22 thickens the peripheral portion of the leading edge 21, thereby preventing deformation of the leading edge 21. The longer the length L, the better the prevention of deformation of the leading edge 21.

A cleaning blade having a leading edge with a desired angle is obtained by properly cutting an elastic sheet material. Each of the reference lines R and Q represents a cutting-plane line of a cutter serving as a cutting member.

From the viewpoint of manufacturability, the leading surface 22 is more preferably curved parabolically as illustrated in FIGS. 7 and 8 than curved asymptotically as illustrated in FIG. 9.

A description is now given of a method of manufacturing the cleaning blade 2. The following is an example method of manufacturing the cleaning blade 2 illustrated in FIG. 7. Of course, the cleaning blade 2 illustrated in FIG. 8 may also be manufactured in a similar way.

Figure 11:
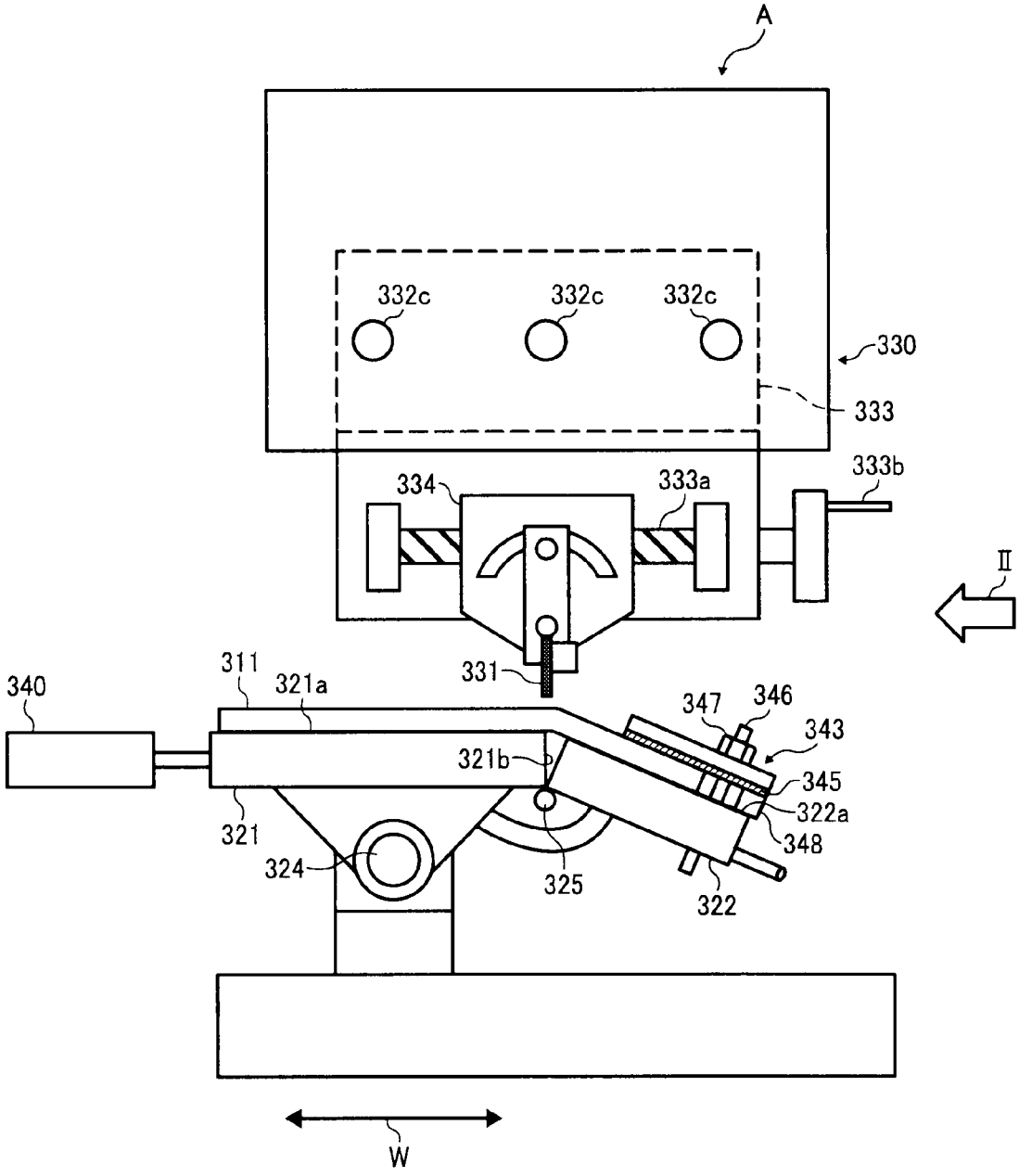
FIGS. 11 and 12 are schematic side and elevation views, respectively, illustrating an embodiment of a cutting device for cutting out the cleaning blade.
Figure 12:
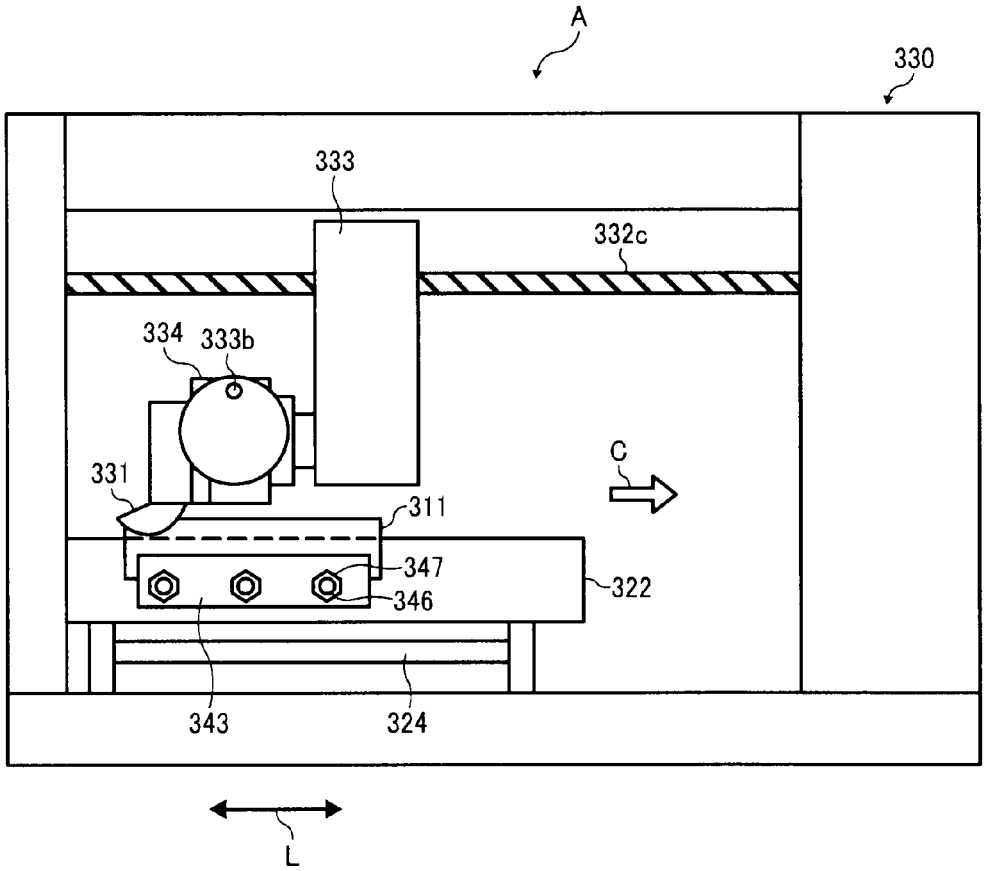
Figure 13:
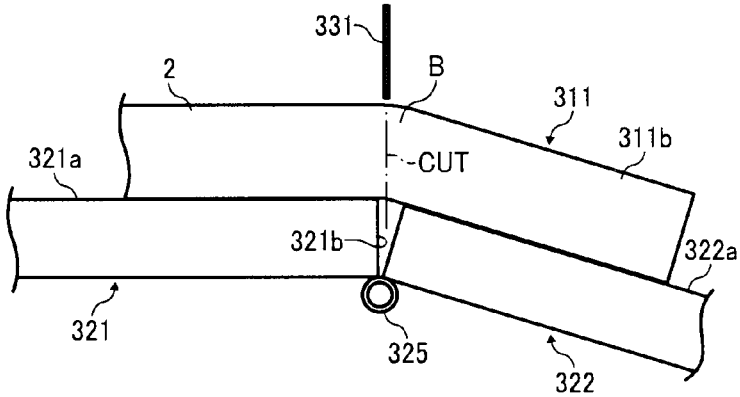
FIG. 13 is a schematic view illustrating how to cut out the cleaning blade.
Figure 14:
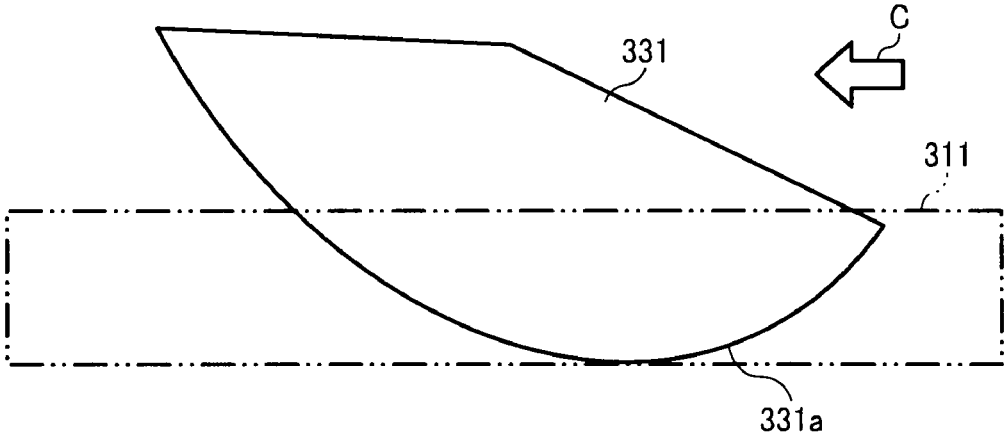
FIG. 14 is a schematic view illustrating a shape of a cutting edge of a cutter of the cutting device.

FIG. 11 is a schematic side view illustrating an embodiment of a cutting device A for cutting out a cleaning blade. FIG. 12 is a schematic elevation view illustrating an embodiment of the cutting device A viewed from a side indicated by arrow II in FIG. 11. FIG. 13 is a schematic view for illustrating how to cut out the cleaning blade. FIG. 14 is a schematic view illustrating a shape of a cutting edge of a cutter of the cutting device A.

Referring to FIG. 11, a first table 321 is horizontally disposed. A second table 322 is disposed so that a second support surface 322*a* of the second table 322 and a first support surface 321*a* of the first table 321 are in the same plane.

First, an elastic sheet 311 is put on the first and second support surfaces 321*a* and 322*a* of the first and second tables 321 and 322, respectively, so that both ends of the elastic sheet 311 in a width direction are parallel to a first table rotating shaft 324 and a second table rotating shaft 325 and a longitudinal length of a part of the elastic sheet 311 put on the first table 311 equals a predetermined length. The part of the elastic sheet 311 put on the first table 321 will be formed into the cleaning blade 2, whereas a remaining part of the elastic sheet 311 put on the second table 322 will not be formed into the cleaning blade 2 and will constitute an unused part. Specifically, the part of the elastic sheet 311 put on the first table 321 covers a whole surface of the first table 321 in the width direction, and the remaining part of the elastic sheet 311 put on the second table 322 covers a left side in FIG. 11 of the second table 322.

Next, an aspirator 340 is brought into operation so that the elastic sheet 311 is fixed onto the support surfaces 321*a* and 322*a* of the first and second tables 321 and 322, respectively.

The elastic sheet 311 is sandwiched between the second support surface 322*a* of the second table 322 and a sheet contact surface 345 of a sandwiching plate 343 with a predetermined pressure by screwing a bolt 346 and a nut 347, while a metal mount 348 is sandwiched between a rightmost end of the second table 322 and the sandwiching plate 343.

The second table 322 is rotated around the second table rotating shaft 325 so as to slant downward for a predetermined angle (about 10 degrees). As a result, a right side in FIG. 11 of the elastic sheet 311 is pulled downward, and a portion B, illustrated in FIG. 13, located immediately above the second table rotating shaft 325 is stretched downward drawing a substantially circular arc around the second table rotating shaft 325.

On the other hand, a cutter shifter 330 shifts a cutter 331 to a cutting starting position while keeping the cutter 331 above the elastic sheet 311. First, the cutting starting position is adjusted in a longitudinal direction (L in FIG. 12) of the sheet, and then in a width direction (W in FIG. 11) of the sheet.

More specifically, in the adjustment of the cutting starting position in the longitudinal direction (L in FIG. 12) of the sheet, referring to FIG. 12, a base 333 is shifted along a gear 332*c* so that the cutter 331 is shifted to a leftmost end in FIG. 12 of the elastic sheet 311. The elastic sheet 311 is then cut by shifting the cutter 331 from a left side to a right side, i.e., in a direction indicated by arrow C in FIG. 12.

In the adjustment of the cutting starting position in the width direction (W in FIG. 11) of the sheet, referring to FIG. 11, a cutter head 334 is shifted along a gear 333*a* by operating an operation handle 333*b* so that the cutter 331 is positioned immediately above a leading surface 321*b* of the first table 321. In other words, referring to FIG. 13, the cutter 331 is positioned immediately above an intersection of the portion B of the elastic sheet 311, which is stretched downward drawing a substantially circular arc around the second table rotating shaft 325, with a portion of the first support surface 321*a* of the first table 321 in planar state.

Next, a cylinder, not shown, of the base 333 is driven to shift the cutter head 334 downward so that a lower end of a cutting edge 331*a* of the cutter 331 reaches a bottom surface of the elastic sheet 311, as illustrated in FIG. 14.

The base 333 is then shifted along the gear 332*c* from a left side to a right side in FIG. 12 so that the elastic sheet 311 is cut by the cutter 331. A part of the elastic sheet 311 fixed on the first table 321 will be formed into the cleaning blade 2, whereas that fixed on the second table 322 will be an unused portion 311*b*, each cut out by the cutter 331.

The tensile stress exerted by the unused portion 311*b* on the cutting of the elastic sheet 311 is greater than that exerted by the portion which will be formed into the cleaning blade 2, each cut out along a cutting line CUT in FIG. 13 (i.e., the reference line Q). In the portion B of the elastic sheet 311, which is stretched downward drawing a substantially circular arc around the second table rotating shaft 325, both the degree of deformation and the tensile stress of an outer side of the circular arc are greater than that of an inner side.

Therefore, when the elastic sheet 311 is cut along the cutting line CUT (i.e., the reference line Q) by the cutter 331, the unused portion 311*b* releases from the cutter 331 to expose a cutting surface. On the other hand, the portion which will be formed into the cleaning blade 2 remains in contact with or slightly apart from a side surface of the cutter 331, because of having a small tensile stress.

The cutting surface (i.e., the leading surface) 22 of the resultant cleaning blade 2 thus cut out has a curved surface curving slightly outward, whereas the cutting line CUT (i.e., the reference line Q) is vertical. This is because the degree of deformation of an outer side of the circular arc farther from the second table rotating shaft 325 is larger than that of an inner side of the circular arc closer to the second table rotating shaft 325, in the cutting position of the elastic sheet 311 by the cutter 331. When the elastic sheet 311 returns to its normal shape after being cut, the degree of restitution of the outer side of the circular arc is larger than that of the inner side, resulting in a curved surface curving outward and downward.

When the cutting line CUT is vertical, i.e., the cutting line is equivalent to the reference line Q, the leading surface 22 has a shape as illustrated in FIG. 7. When the cutting line CUT is equivalent to the reference line R, the leading surface 22 has a shape as illustrated in FIG. 8.

The angle θ is preferably from 95° to 140°. When the angle θ is too small, the stick-slip motion of the cleaning blade 2 may not be reliably prevented. When the angle θ is too large, the cleaning blade 2 may contact a cleaning target at an improper pressure.

The following experiments were performed by inventors of the present invention to study a relation between the shape of the leading edge of a cleaning blade and an abrasion property, that is, a propensity to wear down thereof.

The following five blades Nos. 1 to 5 each having different-shaped leading edges made of the same material were prepared, and each of the blades was brought into contact with a photoconductor under the same conditions to evaluate an abrasion property.

Figure 15:
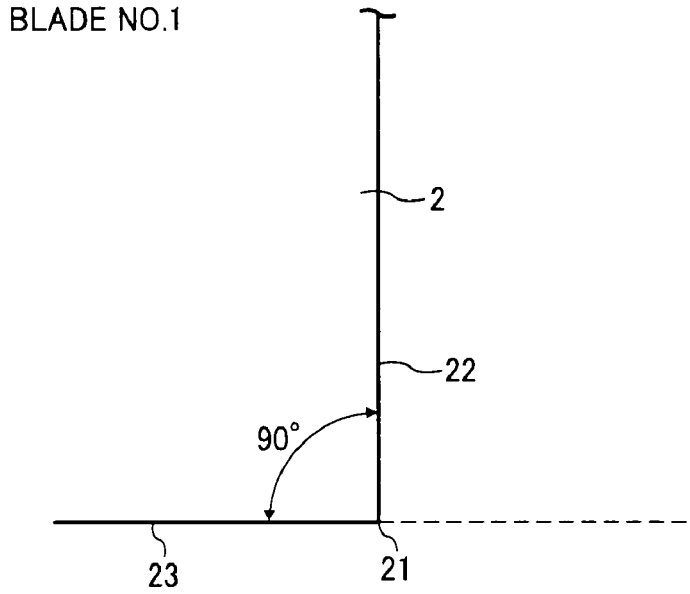
FIGS. 15 to 19 are magnified cross-sectional views illustrating embodiments of the blades No. 1 to No. 5, respectively, at the peripheral portion of the leading edge.

FIG. 15 is a magnified cross-sectional view illustrating an embodiment of the blade No. 1 at the peripheral portion of the leading edge 21. In FIG. 15, the lower surface 23 and the leading surface 22 form an angle of 90°, and the leading surface 22 is straight, that is, perpendicular to the lower and leading surfaces.

Figure 16:
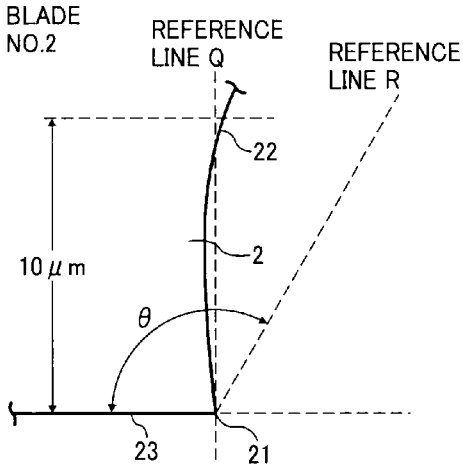

FIG. 16 is a magnified cross-sectional view illustrating an embodiment of the blade No. 2 at the peripheral portion of the leading edge 21. In FIG. 16, the leading surface 22 is curved inward relative to the reference line Q.

Figure 17:
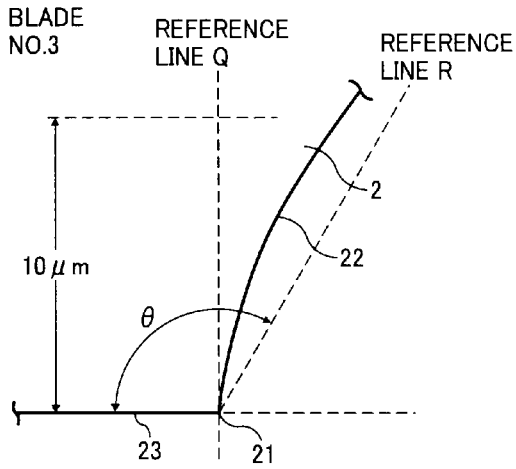

FIG. 17 is a magnified cross-sectional view illustrating an embodiment of the blade No. 3 at the peripheral portion of the leading edge 21. In FIG. 17, the leading surface 22 is parabolically curved inward relative to the reference line R.

Figure 18:
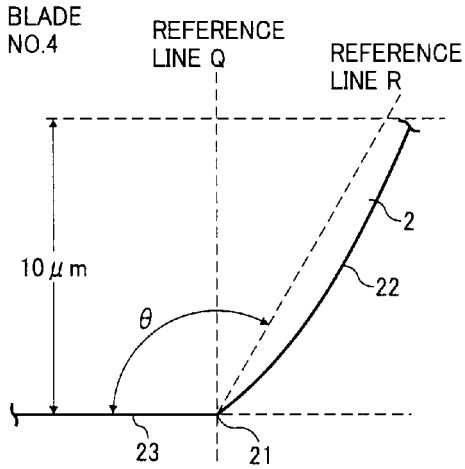

FIG. 18 is a magnified cross-sectional view illustrating an embodiment of the blade No. 4 at the peripheral portion of the leading edge 21. In FIG. 18, the leading surface 22 is parabolically curved outward relative to the reference line R.

Figure 19:
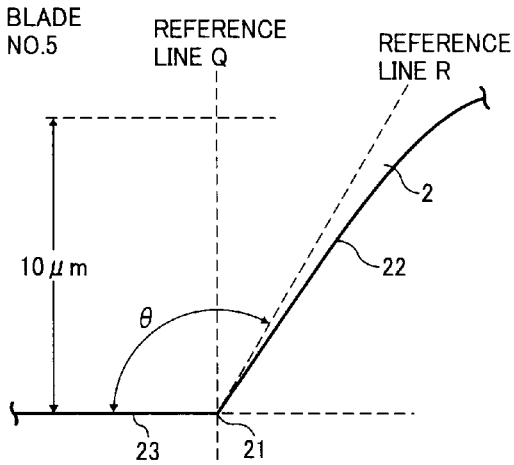

FIG. 19 is a magnified cross-sectional view illustrating an embodiment of the blade No. 5 at the periphery of the leading edge 21. In FIG. 19, the leading surface 22 is asymptotically curved outward relative to the reference line R.

Figure 1B:
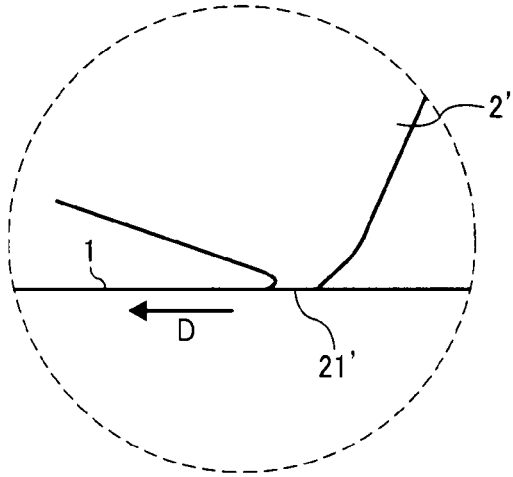
FIG. 1B RELATED ART
Figure 2A:
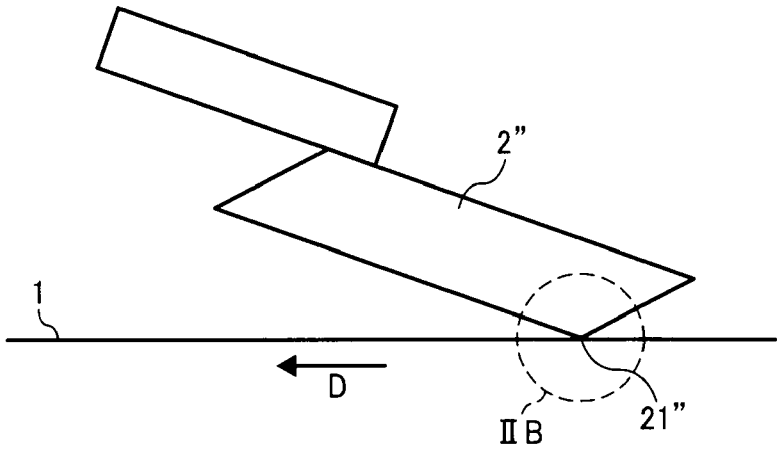
FIG. 2A RELATED ART
FIGS. 2A and 2B are overall and magnified schematic views, respectively, illustrating an embodiment of a related-art cleaning blade of which the leading edge is obtuse-angled.
Figure 2B:
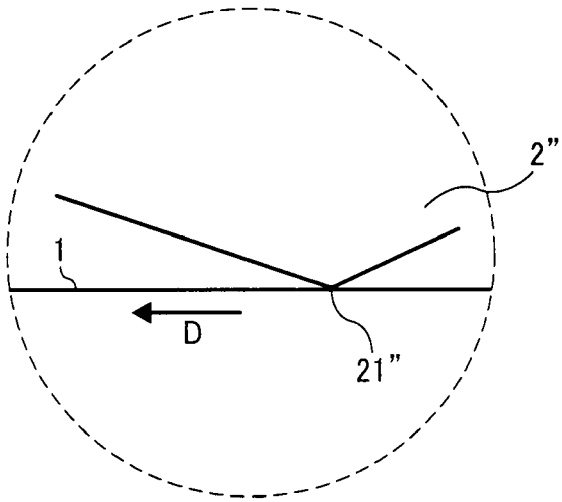
FIG. 2B RELATED ART

The blade No. 1 was cut out from the elastic sheet 311 along the reference line Q without bending the elastic sheet 311. Therefore, the cutting surface (i.e., the leading surface 22) of the blade No. 1 is straight, as well as the cleaning blade 2' illustrated in FIGS. 1A and 1B, of which the leading surface is perpendicular to the lower and upper surfaces thereof.

By contrast, each of the blades Nos. 2 to 5 was cut out along the reference line R, resulting in the cutting surface (i.e., the leading surface 22) illustrated in FIGS. 16 to 19, respectively. The blades Nos. 2 to 5 each have a similar configuration to that of the cleaning blade 2 illustrated in FIG. 6, of which the leading surface forms obtuse and acute angles with the lower and upper surfaces thereof, respectively.

Figure 20:
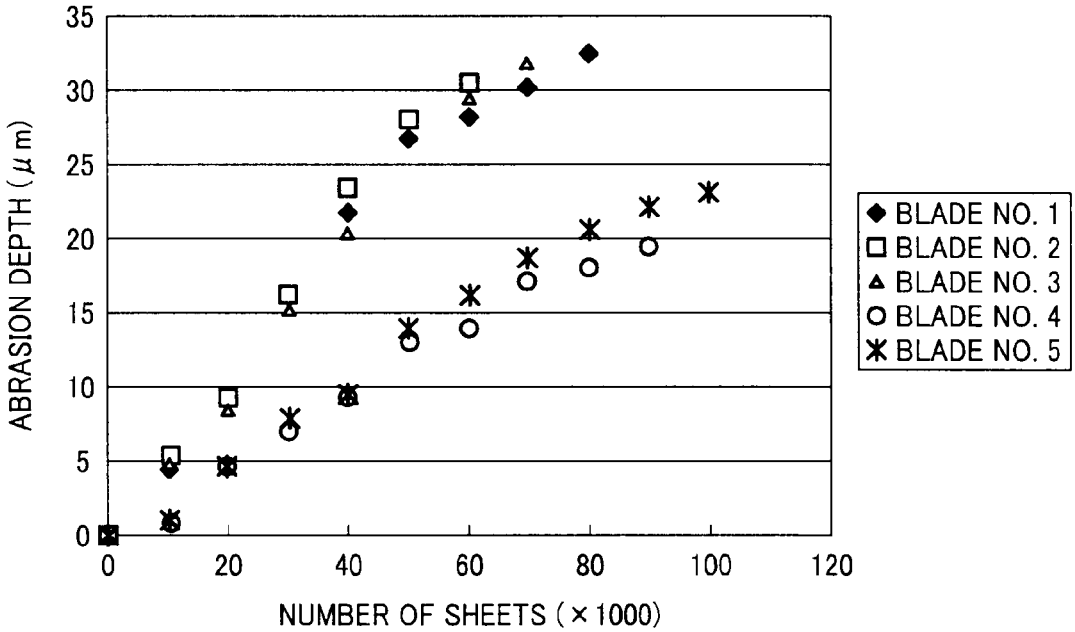
FIG. 20 is a graph showing results of experiments performed to evaluate abrasion property of the blades No. 1 to No. 5.

FIG. 20 is a graph showing the results of the above-described experiments. It is apparent from FIG. 20 that the blades Nos. 2 and 3 have substantially the same abrasion properties as the blade No. 1. The reason therefor is considered as follows.

The angle between the leading and lower surfaces of the blade No. 2 is an obtuse angle when taking a broad view thereof. However, the angle may be considered as substantially a right angle when taking a narrow view of the peripheral portion of the leading edge 21, as well as the blade No. 1.

A peripheral portion of the leading edge 21 of the blade No. 3 is thicker than that of the blade No. 2. However, it is considered that such a thickness of the blade No. 3 is yet too small to prevent deformation of the leading edge 21. Therefore, the leading edge 21 of the blade No. 3 is considered to behave like the blade No. 1, resulting in the same abrasion property as the blade No. 1.

By contrast, the peripheral portion of the leading edge 21 of the blade No. 4 has a sufficient thickness to prevent deformation of the leading edge 21, because the leading surface 22 is curved outward relative to the reference line R. Therefore, the abrasion depth of the blade No. 4 is about one-half of that of the blades Nos. 1 to 3.

Similarly, the peripheral portion of the leading edge 21 of the blade No. 5 has a sufficient thickness to prevent deformation of the leading edge 21, because the leading surface 22 is curved outward relative to the reference line R. Therefore, the abrasion depth of the blade No. 5 is about one-half of that of the blades Nos. 1 to 3.

It is apparent from the above results that when making the peripheral portion of the leading edge 21 thick by curving the leading surface 22 outward relative to the reference line, deformation of the leading edge 21 can be prevented. Because being resistant to abrasion, such a cleaning blade can contact a photoconductor with a high surface pressure, resulting in good cleaning performance.

Figure 21:
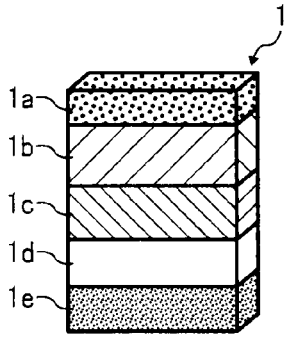
FIG. 21 is a schematic cross-sectional view illustrating an embodiment of the photoconductor included in the printer.

In order to remove residual toner particles, particularly spherical toner particles, from a surface of the photoconductor 1 in the printer 200, the cleaning blade 2 needs to contact the photoconductor 1 with a high pressure, possibly causing abrasion of the surface of the photoconductor 1. For this reason, the photoconductor 1 has a surface protection layer. Specifically, the photoconductor 1 is a negatively-chargeable organic photoconductor in which a photoconductive layer and the like layers are formed on a drum-shaped conductive substrate having a diameter of 30 mm. FIG. 21 is a schematic cross-sectional view illustrating an embodiment of the photoconductor 1.

As illustrated in FIG. 21, an undercoat layer 1*d* serving as an insulating layer, a charge generation layer (CGL) 1*c* and a charge transport layer (CTL) 1*b* both serving as photoconductive layers, and a surface protection layer (FR) 1*a* are overlaid on a conductive substrate 1*e* serving as a base layer in this order.

Suitable materials for use as the conductive substrate 1*e* include material having a volume resistivity not greater than $10^{10}$ Ω·cm. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxides, indium oxides, and the like, is formed by deposition or sputtering. In addition, a metal cylinder can also be used as the conductive substrate, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments. In addition, and endless nickel belt disclosed in Examined Japanese Application Publication No. 52-36016 and an endless stainless belt can be also used as the conductive substrate 1*e*.

Further, substrates, in which a conductive layer is formed on the above-described conductive substrates by applying a coating liquid including a binder resin and a conductive powder thereto, can be used as the conductive substrate 1*e*. Specific examples of such conductive powders include, but are not limited to, carbon black, acetylene black, powders of metals such as aluminum, nickel, iron, nichrome, copper, zinc, and silver, and metal oxides such as conductive tin oxides and ITO. Specific examples of the binder resins include known thermoplastic, thermosetting, and photocrosslinking resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate resins, phenoxy resins, polycarbonate, cellulose acetate resins, ethyl cellulose resins, polyvinyl butyral, polyvinyl formal, polyvinyl toluene, poly-N-vinylcarbazole, acrylic resins, silicone resins, epoxy resins, melamine resins, urethane resins, phenol resins, and alkyd resins. Such a conductive layer can be formed by coating a coating liquid in which a conductive powder and a binder resin are dispersed or dissolved in a proper solvent such as tetrahydrofuran, dichloromethane, methyl ethyl ketone, toluene, and the like solvent, and then drying the coated liquid.

In addition, substrates, in which a conductive layer is formed on a surface of a cylindrical substrate using a heat-shrinkable tube which is made of a combination of a resin such as polyvinyl chloride, polypropylene, polyester, polystyrene, polyvinylidene chloride, polyethylene, chlorinated rubber, and TEFLON®, with a conductive powder, can also be used as the conductive substrate 1*e*.

The charge generation layer 1*c* includes a charge generation material as a main component. Any known charge generation materials can be used for the present invention. Specific examples of usable charge generation materials include, but are not limited to, monoazo pigments, disazo pigments, trisazo pigments, perylene pigments, perynone pigments, quinacridone pigments, quinone-based condensed polycyclic compounds, squaric acid dyes, phthalocyanine pigments, naphthalocyanine pigments, and azulenium salt dyes. These charge generation materials can be used alone or in combination.

The charge generation layer 1*c* can be prepared as follows, for example. First, a charge generation material is dispersed in a solvent optionally together with a binder resin using a typical dispersion means such as a ball mill, an attritor, a sand mill, or an ultrasonic disperser, to prepare a charge generation layer coating liquid. The charge generation layer coating liquid thus prepared is coated on the conductive substrate 1*e* or the undercoat layer 1*d*, followed by drying.

Specific examples of the binder resin optionally used for the charge generation layer 1*c* include, but are not limited to, polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyvinyl pyridine, cellulose resins, casein, polyvinyl alcohol, and polyvinyl pyrrolidone. The charge generation layer 1*c* preferably includes the binder resin in an amount of from 0 to 500 parts by weight, and more preferably from 10 to 300 parts by weight, per 100 parts by weight of the charge generation material included in the charge generation layer 1*c*. The binder resin may be added to the coating liquid either before or after the charge generation material is dispersed therein.

Specific examples of the solvents for use in the dispersion of the charge generation material include, but are not limited to, organic solvents such as isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. Among these solvents, ketone solvents, ester solvents, and ether solvents are preferably used. These solvents can be used alone or in combination.

The charge generation layer coating liquid includes the charge generation material, the solvent, and the binder resin as main components, and optionally includes additives such as an intensifier, a dispersing agent, a surfactant, and a silicone oil.

Suitable coating methods include, but are not limited to, a dip coating method, a spray coating method, a bead coating method, a nozzle coating method, a spinner coating method, and a ring coating method.

The charge generation layer 1*c* preferably has a thickness of from 0.01 to 5 μm, and more preferably from 0.1 to 2 μm.

The charge transport layer 1*b* is formed by applying a charge transport layer coating liquid, in which a charge transport material and a binder resin are dissolved or dispersed in a solvent, on the charge generation layer 1C, followed by drying. One or more additives such as a plasticizer, a leveling agent, and an antioxidant may be optionally added to the charge transport layer coating liquid, if desired.

Charge transport materials are classified into hole transport materials and electron transport materials.

Specific examples of usable electron transport materials include, but are not limited to, electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and benzoquinone derivatives.

Specific preferred examples of usable hole transport materials include, but are not limited to, poly-N-carbazole and derivatives thereof, poly-γ-carbazolylethyl glutamate and derivatives thereof, pyrene-formaldehyde condensates and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives.

These charge transport materials can be used alone or in combination.

Specific examples of usable binder resins for the charge transport layer include, but are not limited to, thermoplastic and thermosetting resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl chloride, polyvinylidene chloride, polyarylate resins, polycarbonate, phenoxy resins, cellulose acetate resins, ethyl cellulose resins, polyvinyl butyral, polyvinyl formal, polyvinyl toluene, poly-N-vinylcarbazole, acrylic resins, silicone resins, epoxy resins, melamine resins, urethane resins, phenol resins, and alkyd resins.

The charge transport layer 1*b* preferably includes the charge transport material in an amount of from 20 to 300 parts by weight, and more preferably from 40 to 150 parts by weight, per 100 parts by weight of the binder resin. The charge transport layer preferably has a thickness of 25 μm or less, from the viewpoint of resolution and responsiveness, and 5 μm or more.

Specific examples of the solvents for use in the dispersion of the charge transport material include, but are not limited to, tetrahydrofuran, dioxane, toluene, dichloromethane, monochlorobenzene, dichloroethane, cyclohexanone, methyl ethyl ketone, and acetone. These solvents can be used alone or in combination.

Alternatively, a single-layer photosensitive layer can be formed by applying a photosensitive layer coating liquid, in which the above-described charge generation material, charge transport material, binder resin, etc. are dissolved or dispersed in a solvent, on the conductive substrate 1*e* or the undercoat layer 1*d*, followed by drying. The photosensitive layer may not necessarily include the charge transport material, and may optionally include additives such as a plasticizer, a leveling agent, and an antioxidant.

Suitable binder resins for use in the photosensitive layer include the above-described resins usable for the charge transport layer and mixtures thereof with the above-described resins usable for the charge generation layer. Charge transport polymers can also be used. The photosensitive layer preferably includes the charge generation material in an amount of from 5 to 40 parts by weight, and the charge transport material in an amount of from 0 to 190 parts by weight, more preferably from 50 to 150 parts by weight, per 100 parts by weight of the binder resin.

The photosensitive layer can be formed by a dip coating method, a spray coating method, a bead coating method, or a ring coating method. Specifically, a photosensitive layer coating liquid in which a charge generation material, a charge transport material, and a binder resin are dispersed in a solvent, such as tetrahydrofuran, dioxane, dichloroethane, and cyclohexane, is applied on the on the conductive substrate 1*e* or the undercoat layer 1*d*, followed by drying. The photosensitive layer preferably has a thickness of from 5 to 25 μm.

The undercoat layer 1*d* typically includes a resin as a main component. Since the photosensitive layer is typically formed on the undercoat layer 1*d* by a wet coating method, the undercoat layer 1*d* preferably has good resistance to the solvent included in the photosensitive layer coating liquid. Suitable resins for use in the undercoat layer 1*d* include, but are not limited to, water-soluble resins such as polyvinyl alcohol, casein, and sodium polyacrylate; alcohol-soluble resins such as copolymer nylon and methoxymethylated nylon; and cured resins forming a three-dimensional network structure such as polyurethane, melamine resins, phenol resins, alkyd-melamine resins, and epoxy resins.

In addition, to prevent the occurrence of moiré and to decrease residual potential, the undercoat layer 1*d* can include fine powders of metal oxides such as titanium oxide, silica, alumina, zirconium oxide, tin oxide, and indium oxide. The undercoat layer 1*d* can be prepared by a typical coating method using a proper solvent, in the same way as the preparation of the photosensitive layer, or using a silane-coupling agent, a titan-coupling agent, or a chrome-coupling agent.

Further, $Al_2O_3$ prepared by anodic oxidization; and a thin film of an organic material such as polyparaxylylene (parylene) or an inorganic material such as $SiO_2$, $SnO_2$, $TiO_2$, ITO, and $CeO_2$ prepared by a vacuum method can also be used as the undercoat layer 1*d*. The undercoat layer 1*d* preferably has a thickness of from 0 to 5 μm.

To improve abrasion resistance of the photoconductor 1, the surface protection layer 1*a* is provided. Specific preferred embodiments of the surface protection layer 1*a* include, but are not limited to, covering the surface of the photoconductor 1 with an amorphous silicone; and dispersing an alumina, a tin oxide, and the like, on the surface of the charge transport layer.

The embodiment of the photoconductor 1 is not limited to the above-described configurations. For example, the photoconductor 1 may have a single-layer structure in which a photosensitive layer including a charge generation material and a charge transport material are formed on a conductive substrate; a multi-layer structure in which a charge generation layer mainly including a charge generation material and a charge transport layer mainly including a charge transport material are formed on a conductive substrate in this order; a multi-layer structure in which a photosensitive layer including a charge generation material and a charge transport material are formed on a conductive substrate, and a protection layer is further formed on the photoconductive layer; a multi-layer structure in which a charge generation layer mainly including a charge generation material and a charge transport layer mainly including a charge transport material are formed on a conductive substrate in this order, and a protection layer is further formed on the charge transport layer; or a multi-layer structure in which a charge transport layer mainly including a charge transport material and a charge generation layer mainly including a charge generation material are formed on a conductive substrate in this order, and a protection layer is further formed on the charge transport layer.

The surface protection layer 1*a* includes a binder resin having a cross-linking structure such as a three-dimensional network structure. The three-dimensional network structure is formed by cross-linking reactive monomers, a molecule of which has multiple functional groups capable of cross-linking, by application of light or heat. Such a binder resin having the network structure expresses an improved abrasion resistance.

From the viewpoint of electric stability and life, the reactive monomers preferably include a monomer having charge transport ability. In this case, the resultant network structure includes a charge transport site, expressing good protective ability.

Specific preferred examples of usable reactive monomers having charge transport ability include, but are not limited to, a compound including one or more charge transport components and one or more silicon atoms having a hydrolyzable substituent in the same molecule; a compound including a charge transport component and a hydroxyl group in the same molecule; a compound including a charge transport component and a carboxyl group in the same molecule; a compound including a charge transport component and an epoxy group in the same molecule; and a compound including a charge transport component and an isocyanate group in the same molecule. These reactive monomers having charge transport ability can be used alone or in combination. A reactive monomer having a triarylamine structure is more preferably used because of having high electrical and chemical stability and carrier transport ability.

In addition, any known monofunctional or difunctional monomers and oligomers can be used in combination for the purpose of controlling viscosity in a coating process, relaxing stress of the resultant layer, and reducing the surface energy and friction coefficient stress of the resultant layer.

The reactive monomer is subjected to a polymerization or a cross-linking reaction by application of heat or light. In a case the reaction is performed by application of heat, a thermal polymerization initiator is optionally needed so that the reaction proceeds. The thermal polymerization initiator is preferably used because the reaction effectively proceeds at lower temperatures.

In a case the reaction is performed by application of light, an ultraviolet light is preferably used. However, the reaction hardly proceeds only by application of light, and therefore a photopolymerization initiator is typically used in combination. The photopolymerization initiator mainly absorbs ultraviolet light with a wavelength of 400 nm or less so as to produce active species such as a radical and an ion. The thermal polymerization initiator and photopolymerization initiator can be used in combination.

The surface protection layer 1*a* having the above-described network structure has high abrasion resistance. However, such a layer largely contracts in volume in the process of cross-linking. Therefore, if the layer is too thick, a crack may be formed thereon. To overcome this drawback, the surface protection layer 1*a* may have a multi-layer structure in which a lower layer including a low-molecular-weight polymer is formed on a photoconductor side and an upper layer including a cross-linking structure is formed on a surface side.

The surface protection layer 1*a* can be formed by a typical coating method as follows, for example. First, 182 parts by weight of methyl trimethoxysilane, 40 parts by weight of dihydroxymethyl triphenylamine, 225 parts by weight of 2-propanol, 106 parts by weight of a 2% acetic acid, and 1 part by weight of aluminum trisacetylacetonate are mixed to prepare a surface protection layer coating liquid. The surface protection layer coating liquid is applied to the charge transport layer, followed by drying, and then subjected to a heat hardening treatment for 1 hour at 110° C. Thus, a surface protection layer having a thickness of 3 μm is formed.

For another example, first, 30 parts by weight of a hole transport material having the following formula (1) and 0.6 parts by weight of a mixture of an acrylic monomer having the following formula (2) with a photopolymerization initiator (1-hydroxy-cyclohexyl-phenyl-ketone) are dissolved in a mixed solvent including 50 parts by weight of monochlorobenzene and 50 parts by weight of dichloromethane, to prepare a surface protection layer coating liquid. The surface protection layer coating liquid is applied to the charge transport layer by a spray coating method, and then hardened for 30 seconds using a metal halide lamp at a light intensity of 500 mW/cm$^2$. Thus, a surface protection layer having a thickness of 5 μm is formed.

(1)

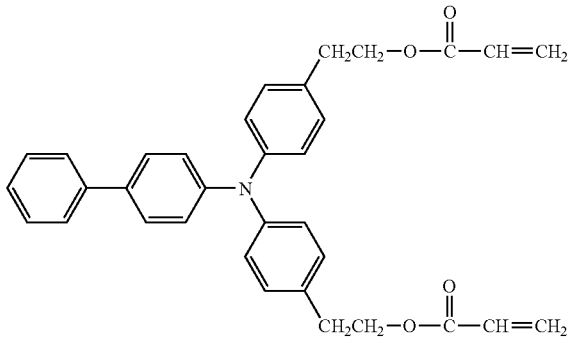

(2)

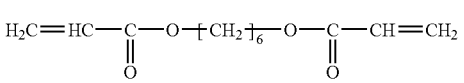

A description is now given of illustrative variations of the process unit 100.

Figure 22:
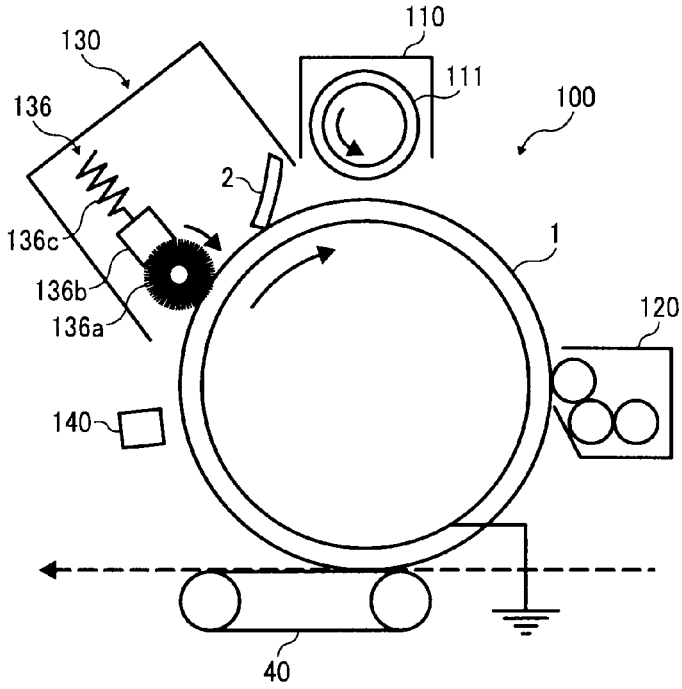
FIG. 22 is a schematic view illustrating an embodiment of the process unit according to a first illustrative variation.

FIG. 22 is a schematic view illustrating an embodiment of the process unit 100 according to a first illustrative variation.

The process unit 100 according to the first illustrative variation includes a lubricant applicator.

The photoconductor cleaning device 130 includes a brush unit 136 serving as the lubricant applicator configured to apply a lubricant to a surface of the photoconductor 1, after the surface passes the transfer conveyance unit 40 and before the surface enters a nip between it and the cleaning blade 2. The brush unit 136 includes a fur brush 136*a* driven to rotate while contacting the photoconductor 1, a solid lubricant 136*b*, and a spring 136*c* configured to press the fur brush 136*a* and the solid lubricant 136*b* against the photoconductor 1.

The fur brush 136*a* is a roller-shaped brush in which an indefinitely large number of bristles made of an acrylic carbon are implanted in a core material. The fur brush 136*a* is driven to rotate in clockwise direction in FIG. 22 so that leading edges of the indefinitely large number of bristles abrasively contact the photoconductor 1 so as to face in the direction of rotation of the photoconductor 1. The fur brush 136*a* rotates to scrape the solid lubricant 136*b* and powdered lubricant is applied to the surface of the photoconductor 1.

If the fur brush 136*a* is eliminated and the solid lubricant 136*b* abrasively contacts the photoconductor 1 directly, the solid lubricant 136*b* may be locally abraded, or the lubricant may be unevenly applied to the surface of the photoconductor 1. As described above, the fur brush 136*a* scrapes the solid lubricant 136*b* so that the powdered lubricant is applied to the surface of the photoconductor 1. Such a configuration prevents the local abrasion of the solid lubricant 136*b* and uneven application of the lubricant.

The amount of the powdered lubricant applied to the photoconductor 1 is easily controllable by controlling the number of rotations of the fur brush 136*a*. Since the fur brush 136*a* rotates so as to face in the direction of rotation of the photoconductor 1, the powdered lubricant is applied to residual toner particles on the photoconductor 1 before the residual toner particles are brought into contact with the cleaning blade 2, thereby improving cleaning efficiency.

Specific examples of the solid lubricant 136*b* include, but are not limited to, solidified metallic soaps such as zinc stearate, calcium stearate, magnesium stearate, barium stearate, and aluminum stearate. A powder of a lamellar crystal such as zinc stearate is preferably used. Since the lamellar crystal has a layered structure in which amphipathic molecules are self-assembled, the lamellar crystal easily delaminates along layers when a shearing stress is applied. This feature contributes to reduction of friction coefficient. Fatty acid salts, waxes, and silicone oils can be also used as the lubricant.

Specific examples of the fatty acid salts include, but are not limited to, salts of fatty acids (e.g., undecylic acid, lauric acid, tridecyl acid, myristic acid, palmitic acid, pentadecyl acid, stearic acid, heptadecyl acid, arachic acid, montanic acid, oleic acid, arachidonic acid, caprylic acid, capric acid, caproic acid) with metals (e.g., zinc, iron, copper, magnesium, aluminum, calcium).

Figure 23:
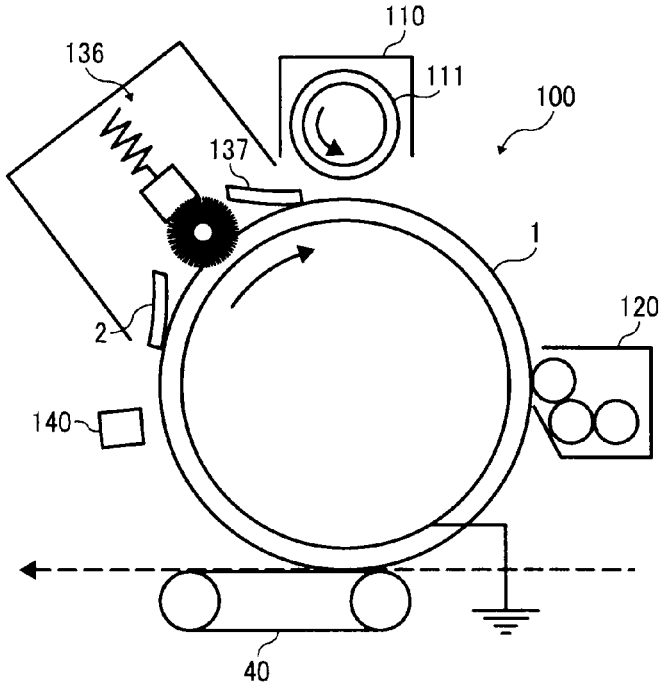
FIG. 23 is a schematic view illustrating an embodiment of the process unit according to a second illustrative variation.

FIG. 23 is a schematic view illustrating an embodiment of the process unit 100 according to a second illustrative variation. As illustrated in FIG. 23, the fur brush 136*a* may apply the powdered lubricant to a surface of the photoconductor 1 cleaned by the cleaning blade 2. In the second illustrative variation, an evening-out blade 137 is provided between the brush unit 136 and the charging device 110, and the leading edge thereof is in contact with a surface of the photoconductor 1. The evening-out blade 137 is configured to even out the powdered lubricant applied to the surface of the photoconductor 1 by the fur brush 136*a*.

In the first illustrative variation illustrated in FIG. 22, the lubricant is applied to the photoconductor 1 at an upstream side from the contact point of the cleaning blade 2 with the photoconductor 1 relative to the direction of movement of the surface of the photoconductor 1. In other words, the lubricant is applied to a surface of the photoconductor 1 which has not been cleaned by the cleaning blade 2. In this case, there is a possibility that the lubricant is removed by the cleaning blade 2 together with residual toner particles, preventing formation of an even film of the lubricant on the surface of the photoconductor 1. Moreover, there is a possibility that a relatively large aggregate of the lubricant is applied to the surface of the photoconductor 1 at one time. If the large aggregate of the lubricant reaches the contact point of the cleaning blade 2 with the photoconductor 1, toner particles and/or external additives on the surfaces of the toner particles may pass through the cleaning blade 2, possibly degrading the resultant image quality. It is preferable that an evening-out member such as an elastic blade (such as the evening-out blade 137) or an elastic roller made of an elastic rubber, etc., is provided in contact with the photoconductor 1 with an appropriate pressure.

In the second illustrative variation illustrated in FIG. 23, the lubricant is applied to a surface of the photoconductor 1 cleaned by the cleaning blade 2. Therefore, the lubricant can be evenly applied to the surface of the photoconductor 1. Further, since the evening-out blade 137 evens out the lubricant applied to the surface of the photoconductor 1 to eliminate aggregate of the lubricant, toner particles and/or external additives on the surfaces of the toner particles are prevented from passing through the cleaning blade 2.

The above-described illustrative embodiments and variations are applicable not only to the process unit 100 but also to any image forming apparatus with no process unit.

The above-described illustrative embodiments and variations are applicable not only to the photoconductor cleaning device 130 configured to remove residual toner particles remaining on the photoconductor 1 serving as both a latent image bearing member and a toner image bearing member, but also to any other cleaning devices configured to clean a cleaning target.

Figure 24:
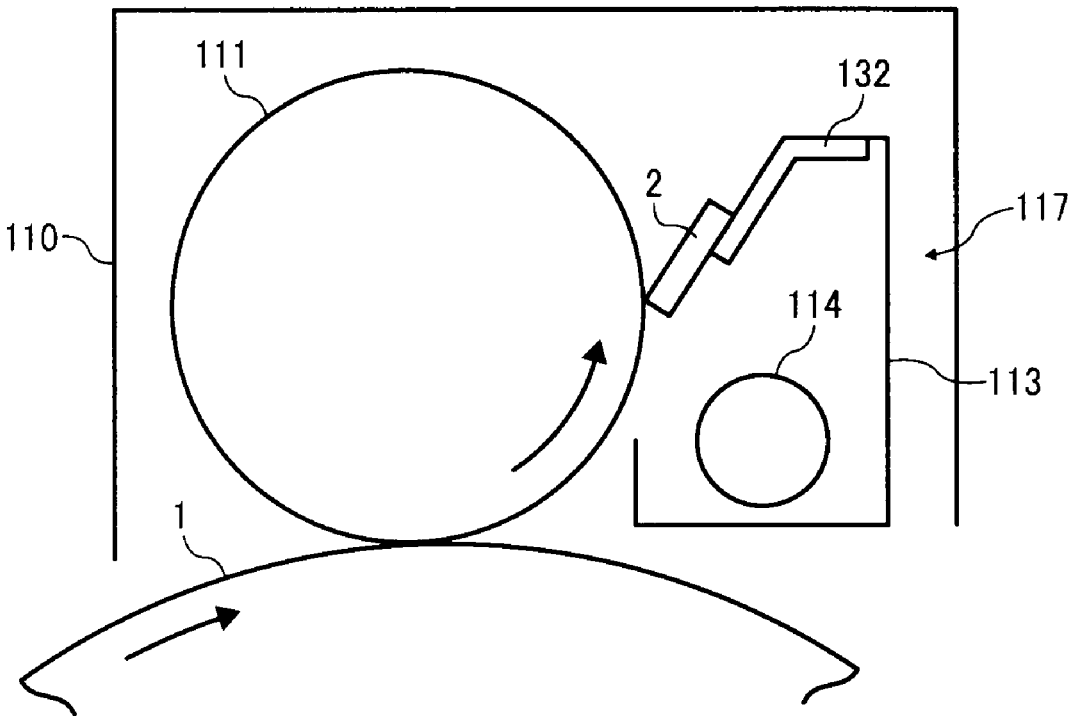
FIG. 24 is a schematic view illustrating an embodiment of another process unit for cleaning a charging roller.

For example, as illustrated in FIG. 24, a cleaning device according to illustrative embodiments of the present invention is applicable to a charging roller cleaning device 117 configured to clean the surface of the charging roller 111 serving as a cleaning target that moves endlessly.

The charging device 110 includes the charging roller cleaning device 117 configured to remove toner particles adhering to the charging roller 111. The charging roller cleaning device 117 includes a casing 113, the holder 132 serving as a support member, the cleaning blade 2 serving as an elastic cleaning blade, and a collection screw 114.

Some residual toner particles that are not transferred but remain on the photoconductor 1 may not be removed by the photoconductor cleaning device 130 and may reach a charging area at which the photoconductor 1 faces the charging roller 111. Since the charging roller 111 is adjacent to or in contact with the photoconductor 1, some of the toner particles reaching the charging area may adhere to the charging roller 111.

Such toner particles adhered to the charging roller 111 in the charging area are removed by the cleaning blade 2 in the charging roller cleaning device 117.

The cleaning blade 2 in the charging roller cleaning device 117 is the same as the cleaning blade 2 in the photoconductor cleaning device 130. Such a configuration reliably removes residual toner particles adhered to the charging roller 111 and prevents abrasion of the cleaning blade 2, resulting in long life.

Since the residual toner particles adhered to the charging roller 111 are reliably removed with the above-described configuration, the charging roller 111 is not required to be removed from contact with the photoconductor 1 so as to prevent adhesion of toner particles. Therefore, the charging roller 111 is preferably provided in contact with the photoconductor 1.

In FIG. 24, the charging device 110 serves as a process unit in which the charging roller cleaning device 117 and the charging roller 111 are integrally supported, and the process unit is detachably attachable to the printer 200.

Figure 25:
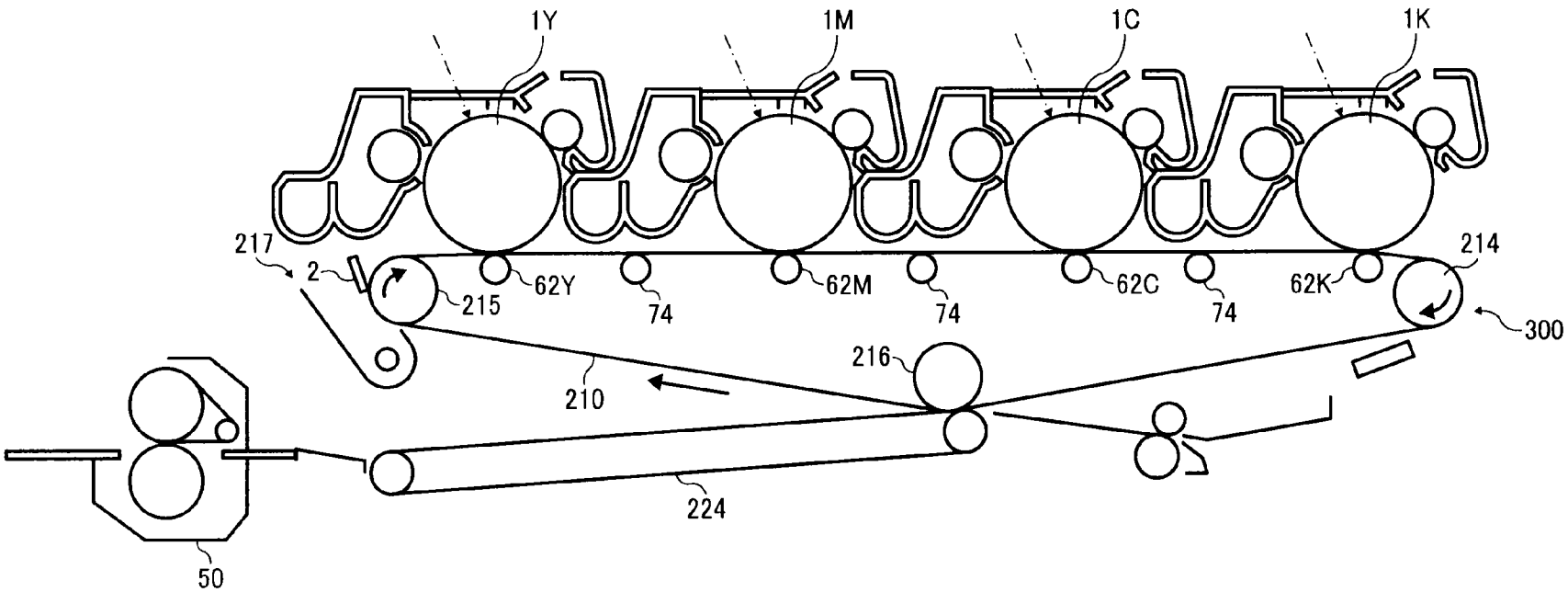
FIG. 25 is a schematic view illustrating an embodiment of yet another process unit for cleaning an intermediate transfer member.

As illustrated in FIG. 25, a cleaning device according to illustrative embodiments of the present invention is also applicable to an intermediate transfer member cleaning device configured to clean the surface of the intermediate transfer member serving as a toner image bearing member.

FIG. 25 is a schematic view illustrating an embodiment of an intermediate transfer unit 300. The intermediate transfer unit 300 is applicable to any known image forming apparatus other than the printer 200.

The intermediate transfer unit 300 includes an intermediate transfer belt 210 serving as an intermediate transfer member, a belt cleaning device 217, a tension roller 214, a driving roller 215, a secondary transfer backup roller 216, four intermediate transfer bias rollers 62Y, 62C, 62M, and 62K, and three ground rollers 74.

The intermediate transfer belt 210 is stretched taut by ten rollers including the tension roller 214, and is endlessly moved clockwise in FIG. 25 by the rotation of the driving roller 215 driven by a driving motor, not shown. The four intermediate transfer bias rollers 62Y, 62C, 62M, and 62K are arranged in contact with an inner surface of the intermediate transfer belt 210, and an intermediate transfer bias is applied thereto from a power source, not shown. The intermediate transfer bias rollers 62Y, 62C, 62M, and 62K press the intermediate transfer belt 210 against photoconductors 1Y, 1C, 1M, and 1K, respectively, from the inner surface of the intermediate transfer belt 210 to form intermediate transfer nips thereat. In each of the intermediate transfer nips, an intermediate transfer electric field is formed between each of the photoconductors 1Y, 1C, 1M, and 1K and each of the intermediate transfer bias rollers 62Y, 62C, 62M, and 62K, respectively, due to the intermediate transfer bias. A yellow toner image is formed on the photoconductor 1Y and then transferred onto the intermediate transfer belt 210 owing to the intermediate transfer electric field and nip pressure. Subsequently, cyan, magenta, and black toner images respectively formed on the photoconductors 1C, 1M, and 1K are sequentially superimposed (transferred) onto the yellow toner image on the intermediate transfer belt 210. Thus, a multi-layered toner image in which four toner images are superimposed on one another (hereinafter "four-color toner image") is formed on the intermediate transfer belt 210.

Each of the ground rollers 74 is disposed between the intermediate transfer nips in contact with an inner surface of the intermediate transfer belt 210. The ground rollers 74 are made of a conductive material. Each of the ground rollers 74 prevents a leakage of current from the intermediate transfer nip to other intermediate transfer nips or a process cartridge due to the intermediate transfer bias transmitted from the intermediate transfer bias rollers 62Y, 62C, 62M, and 62K.

The four-color toner image on the intermediate transfer belt 210 is transferred onto a transfer paper at a secondary transfer nip formed between the intermediate transfer belt 210 and a secondary intermediate transfer belt 224. Residual toner particles which are not transferred at the secondary transfer nip but remain on the surface of the intermediate transfer belt 210 are removed by the cleaning blade 2 of the belt cleaning device 217, sandwiching the intermediate transfer belt 210 with the driving roller 215.

The cleaning blade 2 in the belt cleaning device 217 is the same as the cleaning blade 2 in the printer 200. Such a configuration reliably removes residual toner particles remaining on the intermediate transfer belt 210.

With such a configuration, different-color toner particles do not adhere to other photoconductors, thus preventing the occurrence of color mixing in the resultant image.

The intermediate transfer unit 300 serving as a process unit integrally includes the belt cleaning device 217 and the intermediate transfer belt 210, and is detachably attachable to an image forming apparatus.

In the cleaning device according to illustrative embodiments of the present invention, the cleaning blade 2 is in contact with a surface of the photoconductor 1 that is moving, serving as a cleaning target, so as to clean the surface of the photoconductor 1. The leading edge formed between the lower and leading surfaces of the cleaning blade 2 is obtuse-angled with respect to the lower surface thereof, and the leading surface of the cleaning blade 2 is curved outward when the cleaning blade 2 is not in contact with the surface of the photoconductor 1. Consequently, the peripheral portion of the leading edge 21 is thickened, thereby preventing deformation of the leading edge 21 even when the cleaning blade 2 is stretched in a direction of movement of the photoconductor 1 due to friction with the photoconductor 1. Accordingly, the contact area of the cleaning blade 2 with the surface of the photoconductor 1 can be narrowed, in other words, the surface pressure from the cleaning blade 2 to the photoconductor 1 can be increased. As a result, toner particles are effectively prevented from passing through the contact point of the cleaning blade 2 with the photoconductor 1.

Further, the leading surface 22 of the cleaning blade 2 is preferably curved for $(10/\sin(\pi-\theta))$ μm or more from the leading edge 21 along the leading surface 22, wherein θ represents an angle of the leading edge 21. In such a case that the leading surface 22 is curved outward to thicken the peripheral portion of the leading edge 21, deformation of the leading edge 21 is effectively prevented.

Further, the leading edge 21 is preferably angled from 95° to 140°, thereby consistently preventing deformation of the leading edge 21 with increasing the surface pressure without increasing the linear pressure.

When the cleaning blade 2 cleans a surface of the photoconductor 1, residual toner particles that are not transferred but remain on the surface of the photoconductor 1 are reliably removed.

When the cleaning blade 2 cleans a surface of the charging roller 111 serving as a charging member configured to charge a surface of the photoconductor 1, provided adjacent to or in contact with the photoconductor 1, residual toner particles that are not transferred but adhered to the surface of the charging roller 111 are reliably removed.

When the cleaning blade 2 cleans a surface of the intermediate transfer belt 210 serving as an intermediate transfer member, residual toner particles that are not transferred but remain on the surface of the intermediate transfer belt 210 are reliably removed. Since the intermediate transfer belt 210 bears a plurality of different-color toner images, different-color toner particles are prevented from adhering to other photoconductors 1Y, 1M, 1C, or 1K. Accordingly, the occurrence of color mixing in the resultant image can be prevented.

The process unit 100 includes the photoconductor cleaning device 130 including the cleaning blade 2, and the photoconductor 1 serving as a cleaning target. The process unit 100 is detachably attachable to the printer 200. In the process unit 100, small-sized spherical toner particles are reliably removed with a low linear pressure and a high surface pressure. By the use of the process unit 100, ease of maintenance such as replacement, repair, and replenishment is improved, and the printer 200 is made more compact.

The printer 200 including the photoconductor cleaning device 130 including the cleaning blade 2 provides good cleaning performance with a low linear pressure and a high surface pressure.

When the lubricant applicator 136 is provided so as to apply a lubricant to a surface of the photoconductor 1 after the surface passes the transfer conveyance unit 40 and before the surface enters a nip between the cleaning blade 2, the photoconductor 1 is prevented from being abraded, resulting in high durability.

Alternatively, the lubricant applicator 136 may be provided on a downstream side from the cleaning blade 2 and an upstream side from the charging roller 111 relative to a direction of movement of the surface of the photoconductor 1. This configuration also prevents the photoconductor 1 from being abraded, resulting in high durability. Further, because the lubricant is applied after residual toner particles are removed, the lubricant can be evenly applied to a surface of the photoconductor 1.

Elements and/or features of different illustrative embodiments may be combined with each other and/or substituted for each other within the scope of this disclosure and appended claims.

Illustrative embodiments being thus described, it will be apparent that the same may be varied in many ways. Such illustrative variations are not to be regarded as a departure from the spirit and scope of the present invention, and all such modifications as would be obvious to one skilled in the art are intended to be included within the scope of the following claims.

The number of constituent elements, locations, shapes and so forth of the constituent elements are not limited to any of the structure for performing the methodology illustrated in the drawings.

What is claimed is:

1. An apparatus for manufacturing a cleaning blade from an elastic sheet, comprising:

a cutter to cut the elastic sheet in a predetermined cutting direction;

a cutting table including a first table and a second table each having a support surface to support the elastic sheet, the first and second tables being relatively rotatable around a table rotating shaft, the table rotating shaft being disposed in parallel with the cutting direction;

a cutter shifter to shift the cutter in a thickness direction of the elastic sheet and the cutting direction; and a fixer to fix the elastic sheet to the support surfaces of the first and second tables, wherein a leading edge of the cleaning blade formed between lower and leading surfaces of the cleaning blade is obtuse-angled, and the leading surface is curved outward when the leading edge is not in contact with a cleaning target.

2. The apparatus according to claim 1, wherein the cutter includes an arc-like cutting blade.

3. The apparatus according to claim 1, wherein the fixer includes:

a sandwiching plate to sandwich the elastic sheet with the support surfaces, the sandwiching plate including:

a rigid plate; and a sheet contacting layer disposed on a side of the rigid plate contacting the elastic sheet, the sheet contacting layer being made from a same material as the elastic sheet is made from.

4. The apparatus according to claim 1, wherein the first table and the second table are disposed at a slant relative to each other to form a substantially circular arc in the elastic sheet when the elastic sheet contacts the support surfaces of the first and second tables.

5. The apparatus according to claim 4, wherein the cutter cuts the elastic sheet along a cutting line through the substantially circular arc in the elastic sheet.

6. A method of manufacturing a cleaning blade, comprising:

fixing an elastic sheet on a first support surface of a first table and a second support surface of a second table, the first and second tables being relatively rotatable around a table rotating shaft, the table rotating shaft being disposed in parallel with a predetermined cutting direction;

shifting a cutter in a thickness direction of the elastic sheet and the cutting direction so that the cutter is located in a cutting starting position, the cutting starting position being immediately above a leading surface of the first table; and shifting the cutter in a thickness direction of the elastic sheet and the cutting direction so that the cutter cuts the elastic sheet from the cutting starting position.

7. The method according to claim 6, wherein the cuter includes an arc-like cutting blade.

8. The method according to claim 6, wherein the fixing the elastic sheet includes the elastic sheet being fixed on the first and second support surfaces by being sandwiched with a sandwiching plate and the support surfaces, the sandwiching plate including:

a rigid plate; and a sheet contacting layer disposed on a side of the rigid plate contacting the elastic sheet, the sheet contacting layer being made from a same material as the elastic sheet is made from.

9. The method according to claim 6, wherein the fixing the elastic sheet includes contacting the elastic sheet to the first and second support surfaces, which are disposed at a slant relative to each other, to form a substantially circular arc in the elastic sheet.

10. The method according to claim 9, further comprising:

cutting the elastic sheet with the cutter along a cutting line through the substantially circular arc in the elastic sheet.

* * * * *